US009908120B2

(12) United States Patent
Gharagozlu

(10) Patent No.: US 9,908,120 B2
(45) Date of Patent: Mar. 6, 2018

(54) DEVICE AND METHOD FOR ORE-CRUSHING WITH A SPRING DEVICE

(71) Applicant: Micro Impact Mill Limited, Vaduz (LI)

(72) Inventor: Parviz Gharagozlu, Santiago Centro (CL)

(73) Assignee: Micro Impact Mill Limited, Fürstentum (LI)

( * ) Notice: Subject to any disclaimer, the term of this patent is extended or adjusted under 35 U.S.C. 154(b) by 203 days.

(21) Appl. No.: 14/782,355

(22) PCT Filed: Apr. 7, 2014

(86) PCT No.: PCT/EP2014/056901
§ 371 (c)(1),
(2) Date: Jan. 12, 2016

(87) PCT Pub. No.: WO2014/162011
PCT Pub. Date: Oct. 9, 2014

(65) Prior Publication Data

US 2016/0129450 A1 May 12, 2016

(30) Foreign Application Priority Data

Apr. 5, 2013 (DE) ..... 10 2013 005 943

(51) Int. Cl.
*B02C 7/00* (2006.01)
*B02C 7/14* (2006.01)
(Continued)

(52) U.S. Cl.
CPC ..... *B02C 7/14* (2013.01); *B02C 7/06* (2013.01); *B02C 19/0012* (2013.01); *B02C 21/02* (2013.01)

(58) Field of Classification Search
CPC ..... B02C 7/14; B02C 19/0012; B02C 21/02; B02C 7/06
(Continued)

(56) References Cited

U.S. PATENT DOCUMENTS 1,310,031 A 7/1919 Paschall
2,499,347 A 3/1950 Adams
(Continued)

FOREIGN PATENT DOCUMENTS

DE 296902 3/1917
DE 396976 6/1924
WO 2011038914 4/2011

OTHER PUBLICATIONS (IPEA/409) English Translation of International Preliminary Report on Patentability Chapter II of corresponding PCT application PCT/EP2014/056901, dated May 10, 2015.

*Primary Examiner* — Faye Francis
(74) *Attorney, Agent, or Firm* — Great Lakes Intellectual Property, PLLC

(57) ABSTRACT

The invention regards to a device for comminuting ore and/or slag, which comprises an ore feed unit for feeding ore to be comminuted to a first comminuting means, the first comminuting means being composed of at least two comminuting elements that can be moved relative to each other, which elements form at least one comminuting space for the ore to be comminuted with each other such that, by a relative movement in the form of a rotation around the rotational axis of at least one of the two comminuting elements, the ore to be comminuted is pulverized in that one or more accelerating elements, in particular protrusions, are provided on at least one of the comminuting elements, said accelerating elements being arranged in particular on the end face of one of the two comminuting elements and accelerating and
(Continued)

comminuting the ore to be comminuted by the rotation of one of the two comminuting elements,
and wherein at least one of the two comminuting elements comprises a functional connection with a spring means, wherein the spring means is formed in such a way, that it mounts the comminuting element being in functional connection with variably in the direction of the other comminuting element.

8 Claims, 21 Drawing Sheets

(51) Int. Cl.
*B02C 7/06* (2006.01)
*B02C 19/00* (2006.01)
*B02C 21/02* (2006.01)

(58) Field of Classification Search
USPC ..... 241/261.3, 261.2
See application file for complete search history.

(56) References Cited

U.S. PATENT DOCUMENTS 4,039,153 A 8/1977 Hoffman
8,800,900 B2 8/2014 Gharagozlu

DEVICE AND METHOD FOR ORE-CRUSHING WITH A SPRING DEVICE

TECHNICAL DOMAIN

The present invention relates to a method and to a device for comminuting ore or stone and/or slag, the ore being pulverised using water in a wet process or also without using water in a dry process in a particularly ecological manner.

According to the Fraunhofer Institute humanity will consume annually in the year 2050 140 billions tons of minerals, mineral ores, fossil fuels and biomass. Today we consume one third thereof. Resources will become the key in global competition, in particular in mining. "Reducing energie and resources" is deemed to be the maxim of the indsutrie. Energie efficient innovations are a step towards conserving resources and at the same time a chance to change economy and to set sustainable impulses.

Mining plays a strategic role in terms of production of raw materials. Procedural improvements are the first step for more resource usage instead of resource consumption.

Thus, there is a great need to also use environmentally friendly methods and devices when extracting raw materials, in particular in order to protect the people involved from damage to their health. With the conventional comminution of ore the people involved in the mining have their health compromised by the development of dust which may affect the lungs of the people in question.

Furthermore, there is a need to improve the methods and devices used for mining, in particular for the processing of ore, in such a manner that energy consumption is reduced and damage to the environment is minimised.

PRIOR ART

In a classic view dressing of ore takes place until today in four steps. Multiple crushing machines serially connected crush the produced ore to a defined particle size, which is further crushed in mills, mostly ball mills, by wet-mechanical process. The resulting pumpable suspension becomes classified respectively divided in different grain classes. The last step of processing ore rocks forms floating, a physical-chemical process in which ore containing metal is transported in water by means of gas bubbles sticking thereon to the water surface and which are skimmed there. As end product the ore concentrate results.

Those big crushing machines form the preliminary stage of ore dressing in mining. Dependent on country, region, productivity and size of the mine several try working crusher units and a downstream ball mill including the conveyor mechanism and a sieving mechanism form a chain in ore crushing. Size of the facility, energy and logistic effort for the stoneware as well as dust exposure of the environment are enormous in conventional appliances.

The crushing principle of e.g. a jaw crusher only works with mechanically generated pressure. Crushing of crush items mainly happens in a wedge-shaped shaft between a stationary and an eccentric moved crusher jaw. In the course of movement stoneware is crushed until the material is smaller as an adjusted crush gap.

Moreover it continues in a ball mill: In ball mills the precrushed ore rocks are milled together with iron balls in a drum, which is rotated. Thereby the grist is "squashed" by means of the balls, which results in particle crushing. Inclusive an abrasion of the mill balls itself, which contaminate the ore with the iron of the iron balls.

Ball mills for comminuting ore have been known for a long time, the ore being set in rotation together with iron balls until the desired fineness has been achieved in the ball mill. This type of known ball mill is already known from DE 40 02 29, the grinding cylinder containing balls, flints or similar in order to grind up the ore.

However, in such known ball mills the grinding cylinder must be designed to be particularly robust in order to be able to withstand the balls striking against the cylinder wall without any damage, and for this reason the weight of the grinding cylinder is greatly increased. Consequently, the operating costs and energy input are high with such ball mills. Furthermore, the rotating grinding cylinder is subject to a high degree of wear as a result of the balls striking against the grinding cylinder, and so after a relatively short time both the balls and the grinding cylinder have to be replaced. The iron balls cost between 800 US $/ton, depending on the size and property and are in a minimum of time used due to abrasion, wherein the abrasion causes a contamination of the grist and therewith the following floating respectively the floating process is costlier. Moreover, it is necessary with ball mills for the ore to be ground by a separate comminuting unit and then by one or more ball mills connected one behind the other in order to comminute the ore in the desired manner, effective pulverisation of the ore hardly being possible.

Moreover, such ball mills are not suitable for comminuting or pulverising ore together with slag or slag on its own because slag, which is produced in particular as a waste product when further processing ore, is very brittle and has a hard structure.

Further document WO 2011/038914A1 of the same inventor discloses a very good and small size device for comminuting ore. However according to the type of ore, throughput of the device, etc. a danger of overloading the device exists, whereby damage of the same is conceivable.

DESCRIPTION OF THE INVENTION

It is therefore the object of the present invention to provide a method and a device for comminuting ore and/or in particular slag which is highly effective, only shows a small amount of wear and an overloading protection.

This object is achieved by the device according to the features of claim 1 and by the method according to the features of claim 10.

The invention is based upon the idea of providing a method and a device for comminuting ore, the device according to the invention comprising an ore feed unit for feeding ore to be comminuted to a first comminuting means. The first comminuting means is composed of at least two comminuting elements that can be moved relative to each other, which elements form at least one comminuting space for the ore to be comminuted with each other such that, by a relative movement in the form of a rotation around a rotation axis of at least one of the two comminuting elements the ore to be comminuted is pulverised at east partially in that one or more accelerating elements, in particular protrusions, are provided on at least one of the comminuting elements, said accelerating elements being arranged in particular on the end face of one of the two comminuting elements and accelerating and comminuting the ore to be comminuted by the rotation of one of the two comminuting elements, and wherein between the two comminuting elements and/or in at least one of the two comminuting elements an intermediate space is provided, through which comminuted ore is conveyed during rotation from the center of rotation outwardly and away from the two comminuting elements.

According to the invention at least one of the two comminuting elements comprises a functional connection with a spring means, wherein the spring means is formed in such a way, that it mounts the comminuting element being in functional connection with variably in the direction of the other comminuting element.

This solution is beneficial, since due to the variable mounting of the comminuting element the comminuting element is slideable. Hence, during appliance of forces, which occur during comminuting of ore and which can cause an overloading of the device, the comminuting element is slideable, in particular automatically slideable, whereby immediately unloading of the system respectively the device is caused respectively the occurring forces are reduced.

During a comminuting of ore in the first comminuting means initially a pressure application takes place onto the ore clumps yet slightly or not comminuted. The pressure application is caused by means of a ramp region, which is designed spirally and formed on one or both comminuting elements. Due to the spirally-shaped form a feeding effect is generated during a rotation of a comminuting element, by means of which the ore arranged between the comminuting elements, in particular between the ramp region of one comminuting element and a correspondent region of the other comminuting element, is compressed respectively applied with increasing pressure. The pressure applied to the ore clump normally causes that the ore clumps fall into pieces and thus yield to the pressure. In case of presence of ore clumps not falling into pieces, the generated pressure threatens to further increase, whereby the load of the device components, in particular of the comminuting elements, the actuating shaft, the bearings, etc. also rises significantly and can even reach a level above which damage of individual or several of said components is possible. Due to the usage of a spring means according to the invention overloading of the components during operation of the first comminuting means can be avoided. Because, the spring means deflects in case the load becomes too high respectively exceeds a defined, in particular adjusted, level. A sliding of one comminuting element results due to the deflection of the spring means, whereby the comminuting elements are spaced apart from each other. After respectively in case of a pressure drop between the comminuting elements the deflected spring means causes a returning of the comminuting element into the initial position. Due to the sliding of the comminuting element a slit between the comminuting elements was enlarged, through which larger ore particles respectively ore clumps can get out of the first comminuting means. All ore particles respectively ore clumps which got out of the first comminuting means are guided to a separating means, due to which separation of the already sufficiently comminuted particles and the not yet sufficiently comminuted particles respectively ore clumps takes place. The not yet sufficiently comminuted ore particles respectively ore clumps are then again fed to the first comminuting means or to a second comminuting means.

Further, it is also conceivable that ore particles respectively ore clumps can be present in the region of the comminuting protrusions of the comminuting elements and do not fall into pieces due to the applied pressure. Since the comminuting protrusions of the comminuting elements are arranged radially spaced apart from the center of the comminuting protrusions the ore particles respectively ore clumps are causing high momentums in this region, which can lead to a damaging of the first comminuting means, in particular of one or both comminuting elements, the actuating shaft, etc. The arrangement of a spring means according to the invention enables, preferably also in case, that a deflection of a comminuting element takes place, in particular the comminuting element which is coupled with the shaft.

Further beneficial embodiments of the inventive device and the inventive method result from the dependent claims and/or from the following specification.

According to a preferred embodiment of the present invention at least one of said comminuting elements is arranged at the shaft for actuating the comminuting element, wherein the spring means is directly coupled with the shaft or the comminuting element and is pretensioned by it and wherein the shaft and the comminuting element arranged thereon are slideable opposite to the spring force of the spring means. This embodiment is beneficial, since a protection of the comminuting elements and the shaft, which is connected with one comminuting element, is in particular caused thereby.

A sliding of the shaft and the comminuting element takes place according to a further preferred embodiment in dependency of the pretension of the spring means, wherein a deflection of the spring means results during operation of the first comminuting means because of a deflection force generated between the two comminuting elements and directed opposite to the contact pressing force resulting from the spring force, in case the deflection force exceeds the contact pressing force. This embodiment is beneficial, since the spring force preferably serves as essential parameter for position changes of the shaft and/or the comminuting element. The spring force is preferably arbitrarily modifiable, whereby optimized adjustments respectively configurations are foreseeable for most different operation and/or boundary conditions.

According to a further preferred embodiment of the present invention the spring means comprises a mechanical spring means, in particular a spiral spring, a pneumatic spring means and/or a hydraulic spring means. This embodiment is beneficial, since the spring means is provideable with respect to operation and/or boundary conditions, whereby the device according to the invention is optimal adjustable.

The spring means has multiple suspension means, wherein the single suspension means are arranged in such a manner that they are pushing the comminuting element coupled with the shaft into the direction of the other comminuting element. This embodiment is beneficial since the different suspension means can be shaped equally or differently, whereby a very precise adjustment of the desired overall spring forces is in return causeable.

According to a further preferred embodiment of the present invention the shaft is mounted in a housing of the device by means of roller bearings and coupled with a actuating means for rotating the shaft and the comminuting element arranged thereon. The mounting by means of roller bearings is beneficial since roller bearings can handle high forces and are very good adjustable. Furthermore, this embodiment is beneficial since the roller bearings are preferably arranged in the housing of the device according to the present invention and are thus protected against environmental influences.

The spring means is arranged in an end region of the shaft respectively coupled with the shaft according to a further preferred embodiment of the present invention, wherein the end region is spaced apart from a second end region of the shaft, on which the comminuting element is arranged. Between the end regions of the shaft are preferably arranged the roller bearing for mounting the shaft. Further, preferably in the region of the end in which the spring means is provided also an actuating means respectively a coupling with a actuating means is provided. This embodiment is beneficial since the spring means is preferably as much as possible spaced apart from the comminuting element to preferably avoid damaging or negative functional impacts due to the comminuted ore.

According to a further preferred embodiment of the present invention the comminuting element is arranged in the direction of extention of the rotational axis at a housing of the device at least time-wise closing housing cover, wherein the housing cover is moveable with respect to the device and wherein the fixed arranged comminuting element is pressed against the other comminuting element by means of the spring means, which connects the housing cover with the device. The spring means is preferably formed as hydraulic spring means and is particular preferably formed by a hydraulic means, which also enables a displacement of the housing cover for opening and closing of the housing for e.g. maintenance work. It is also conceivable that the comminuting element arranged at the housing cover is mounted respectively pretensioned via a spring means and the comminuting element arranged at the shaft is mounted respectively pretension by means of a further spring means.

The spring constant of the spring means, the sliding path of the comminuting element and/or the deflection path of the spring means are changeable, in particular adjustable or exchangeable, due to a further preferred embodiment. Adjustable means hereby e.g. that due to a manipulation of the present items a change of the further variables takes place. Thus, e.g. in case a mechanical spring is provided it is e.g. manipulatable respectively compressible by means of a screw, whereby the potential deflection path decreases. Further in case of presence of e.g. a pneumatic spring the pressure in a pneumatic cylinder is changeable. A change of one of the mentioned variables by means of exchanging a component means the replacing of said component by another component with preferably other physical and/or mechanical properties. So, e.g. in presence of a mechanical spring another mechanical spring is usable, which consists of another material, is larger, has another form, etc.

Furthermore, it is conceivable that the sliding path of the comminuting element being in a functional connection with the spring means is during operation of the first comminuting means less than 5 cm and preferably less than 3.5 cm and particular preferably less than 1 cm. Further it is conceivable that the contact pressing force generated by the spring means amounts at least 1000 N, preferably at least 2000 N and particular preferably at least 10000 N.

Furthermore, the subject-matter of a further patent application filed by the same applicant at the same day by the same patent office, which also refers to a device and a method for ore comminuting is fully incorporated into the subject-matter of the present patent application by reference.

Individual or all representations of figures described in the following are preferably considered as constructional drawings, that means that the dimensions, proportions, functional contexts and/or arrangements correspond preferably exactly or preferably essentially to those of the device according to the invention respectively the products according to the invention.

Further benefits, goals and features of the present invention will be described by the following specification of the attached figures, in which exemplarily devices for crushing ore according to the invention are illustrated. Components of the device according to the inventions, which match at least essentially with respect to their function can be marked with the same reference sign, wherein such components do not have to be marked or described in all figures.

In the following the invention is just exemplarily described with respect to the attached figures.

In the following the invention will be described, purely by way of an example, by means of the attached figures.

Figure 1:
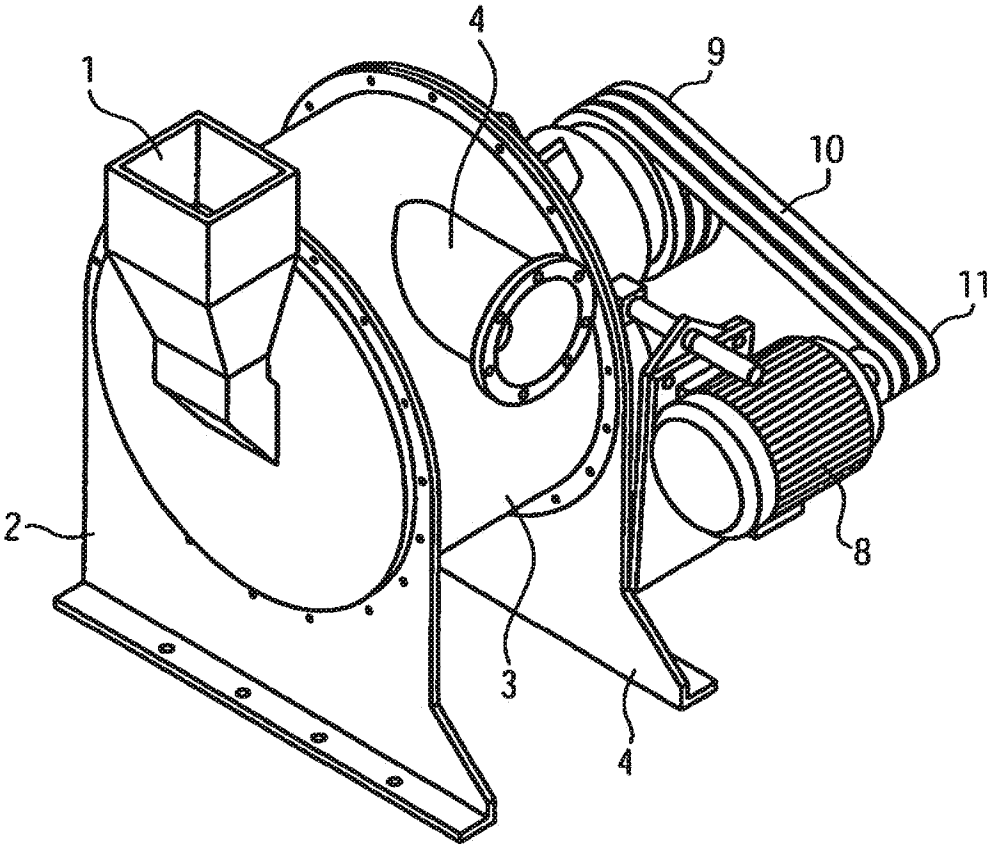
FIG. 1 shows a perspective view of a part of the device according to the invention.
Figure 6B:
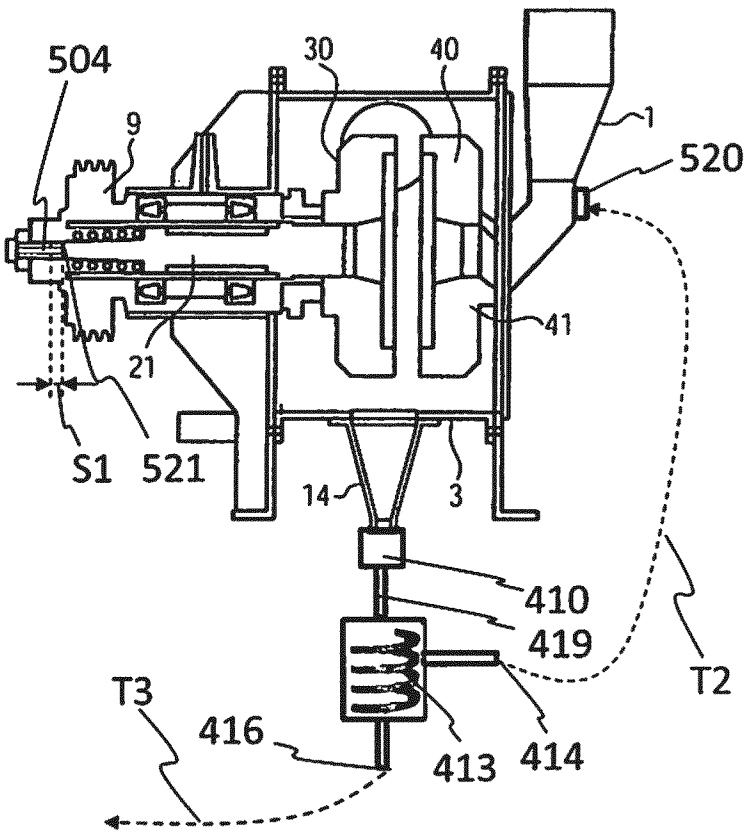
Figure 6A:
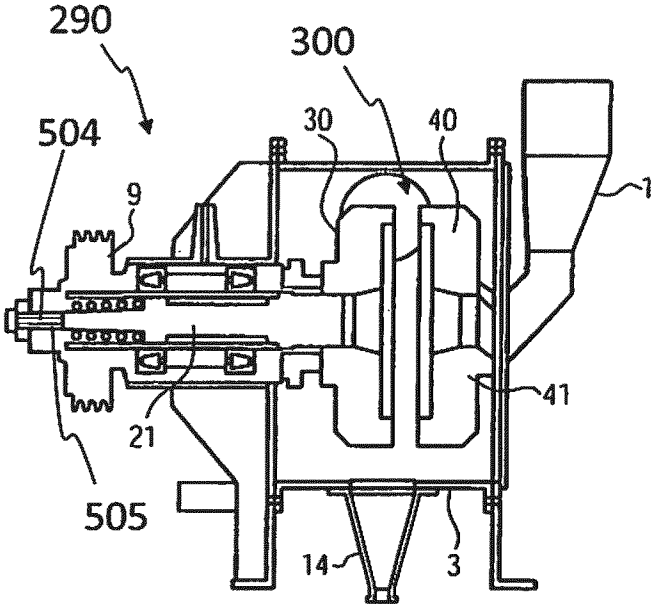
Figure 7:
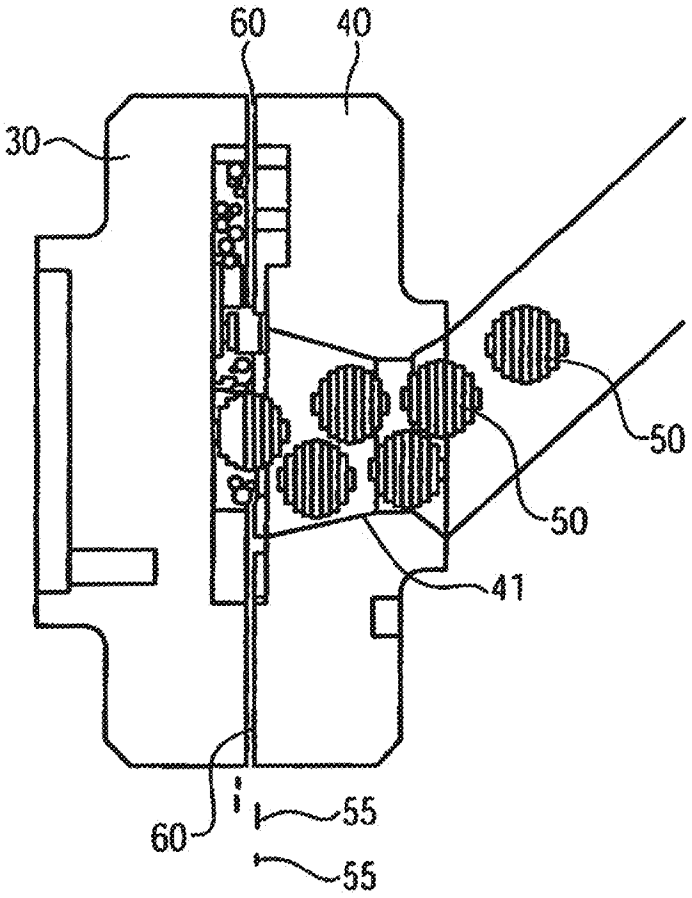
Figure 8:
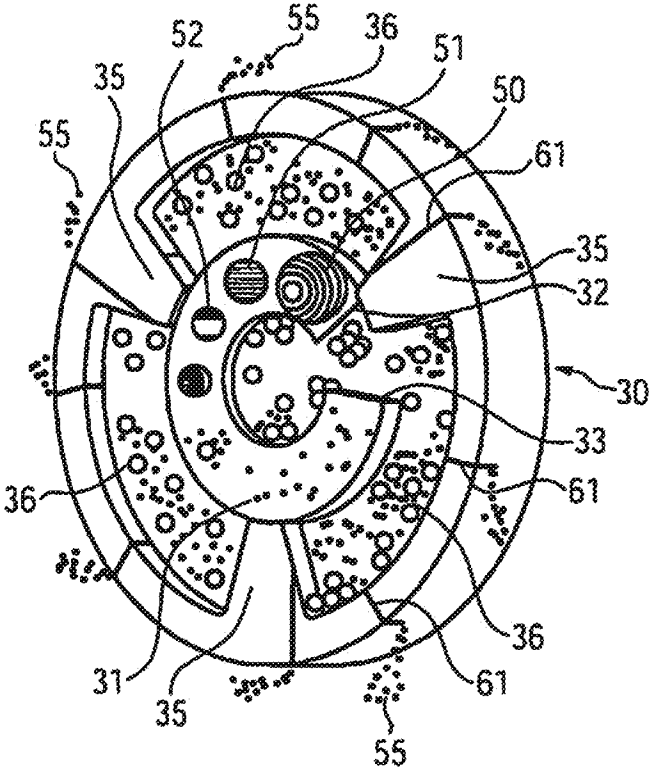
Figure 8:
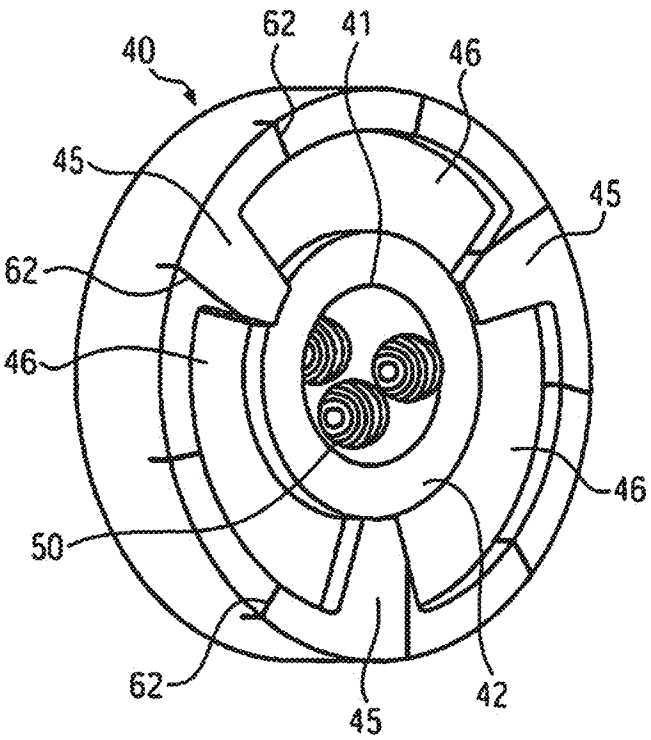
Figure 9:
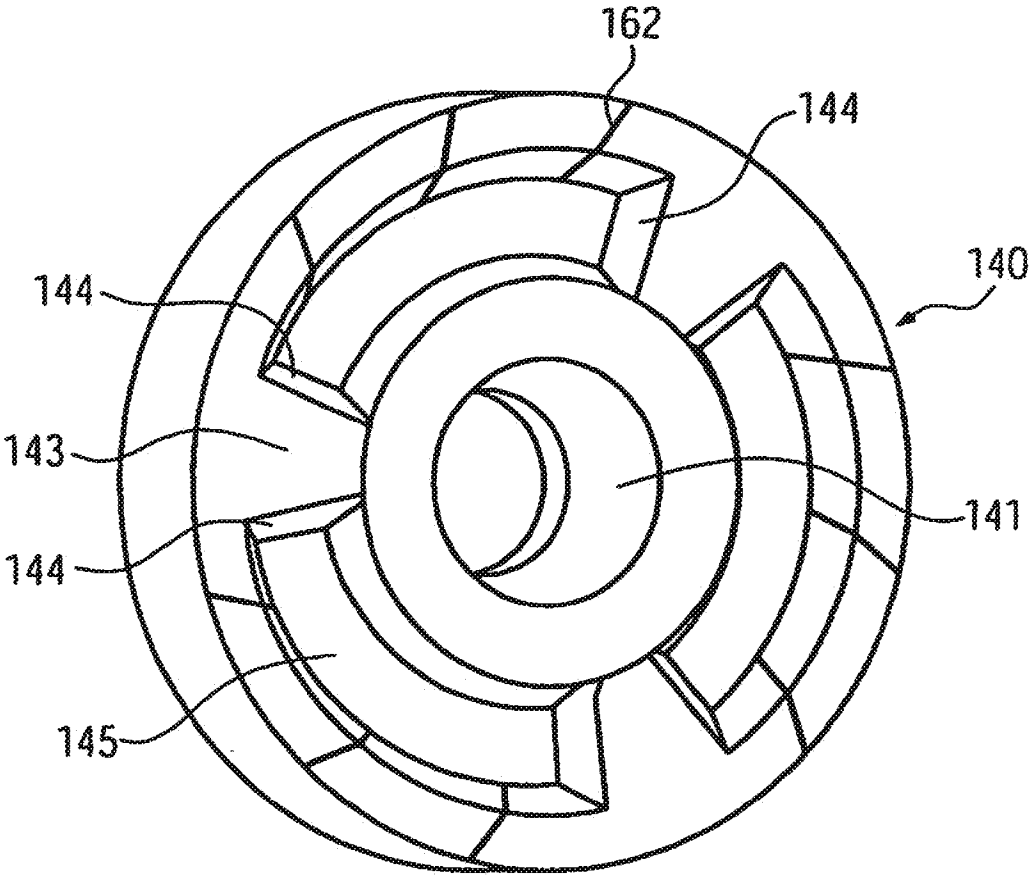
Figure 10:
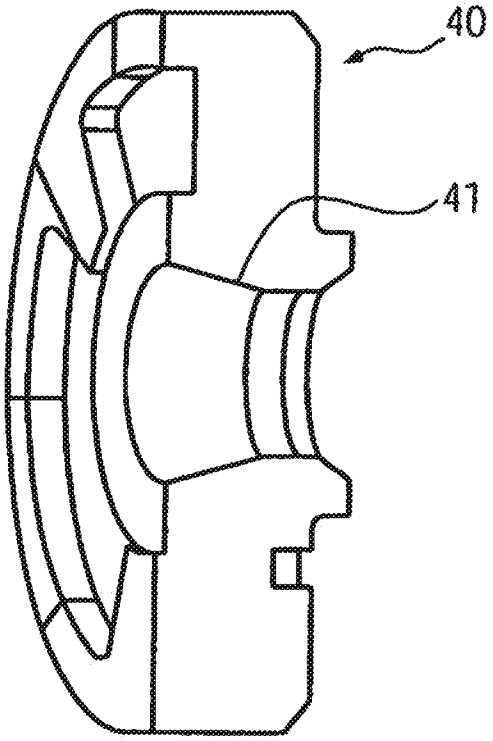
Figure 11:
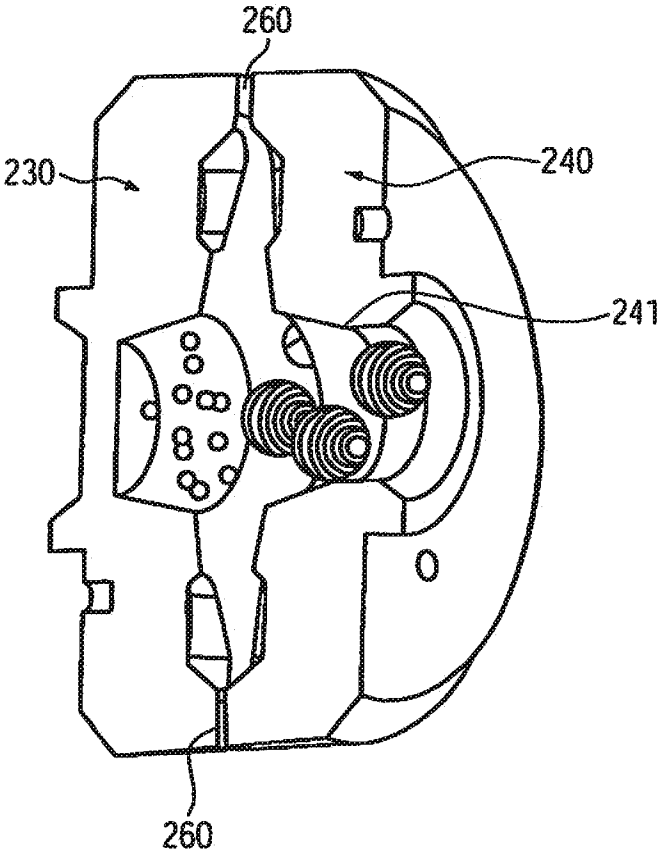

FIG. 6*a* shows a part of the device according to the invention of FIG. 1, partially as a cross-section;

FIG. 6*b* shows the illustration of FIG. 6*a* broadened by a separator and respective components FIG. 7 shows diagrammatically the two comminuting elements of FIG. 6 as a cross-section;

FIG. 8 shows the two comminuting elements of FIG. 7 in an opened up position;

FIG. 9 shows a comminuting element analog to FIG. 8, illustrated diagrammatically;

FIG. 10 shows the comminuting element of FIG. 8, partially as a cross-section;

FIG. 11 shows further embodiments of the comminuting elements for the part of the device according to the invention shown in FIG. 6*a;*

Figure 12:
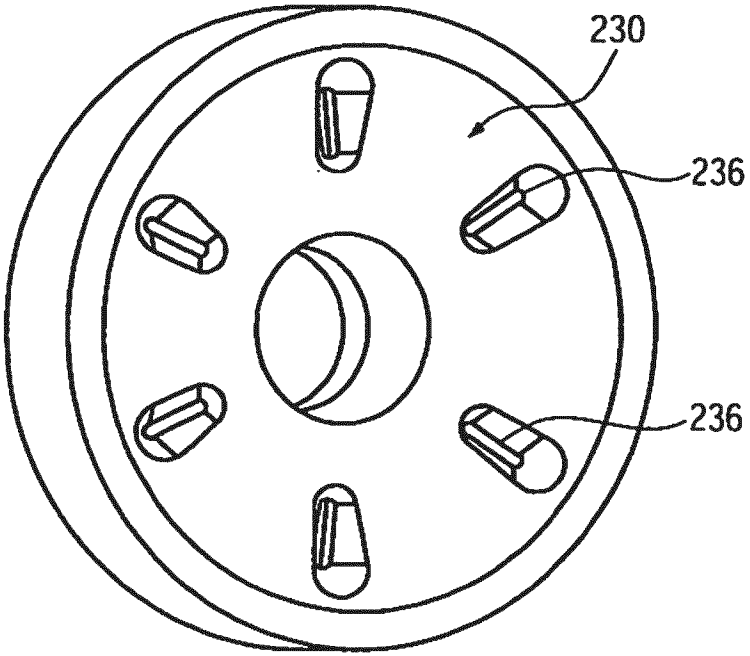

FIG. 12 shows diagrammatically a comminuting element of FIG. 11; and

Figure 13:
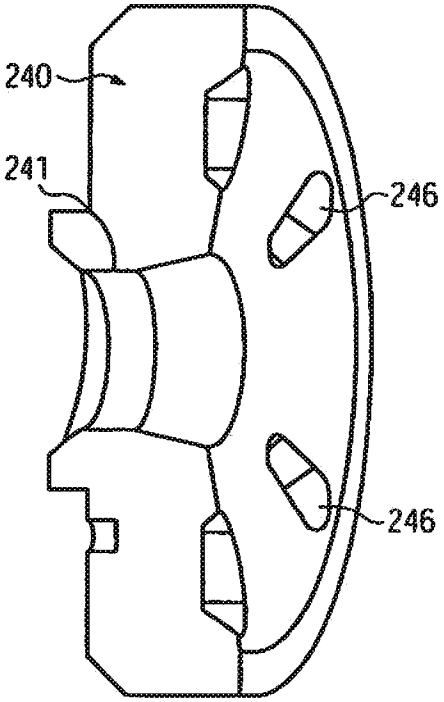

FIG. 13 shows the other comminuting element of FIG. 1, partially as a cross-section.

Figure 14:
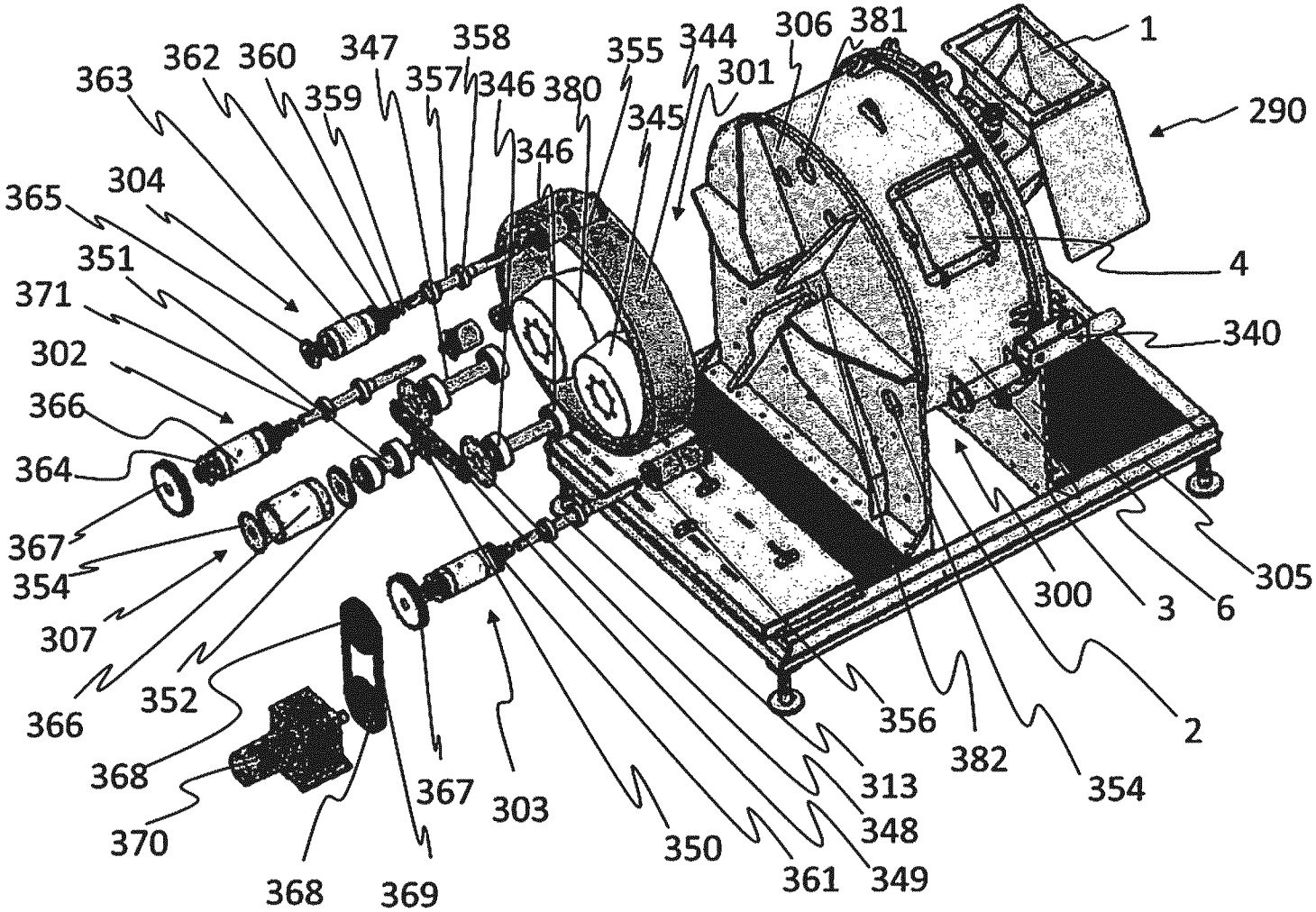
Figure 15:
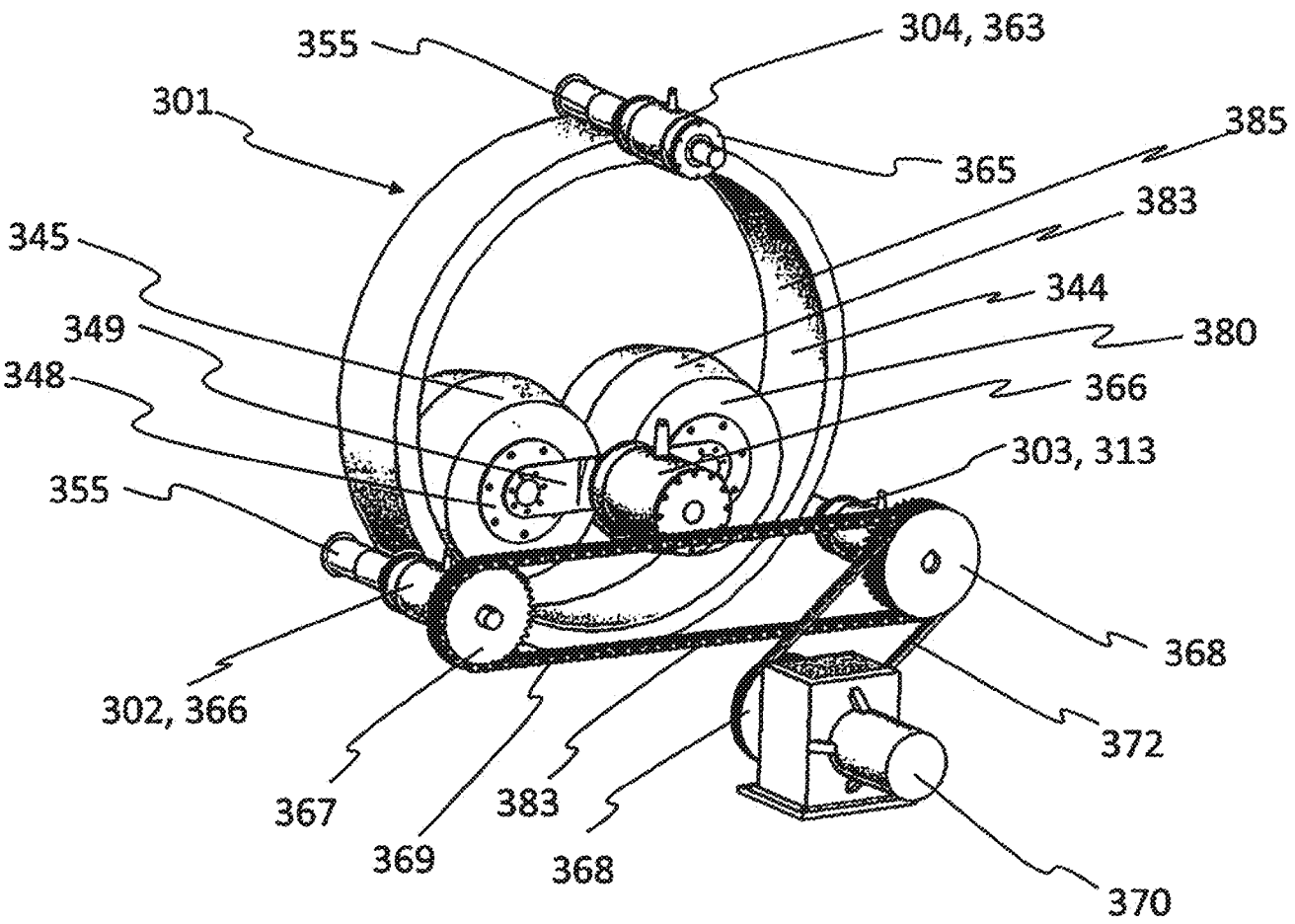
Figure 16:
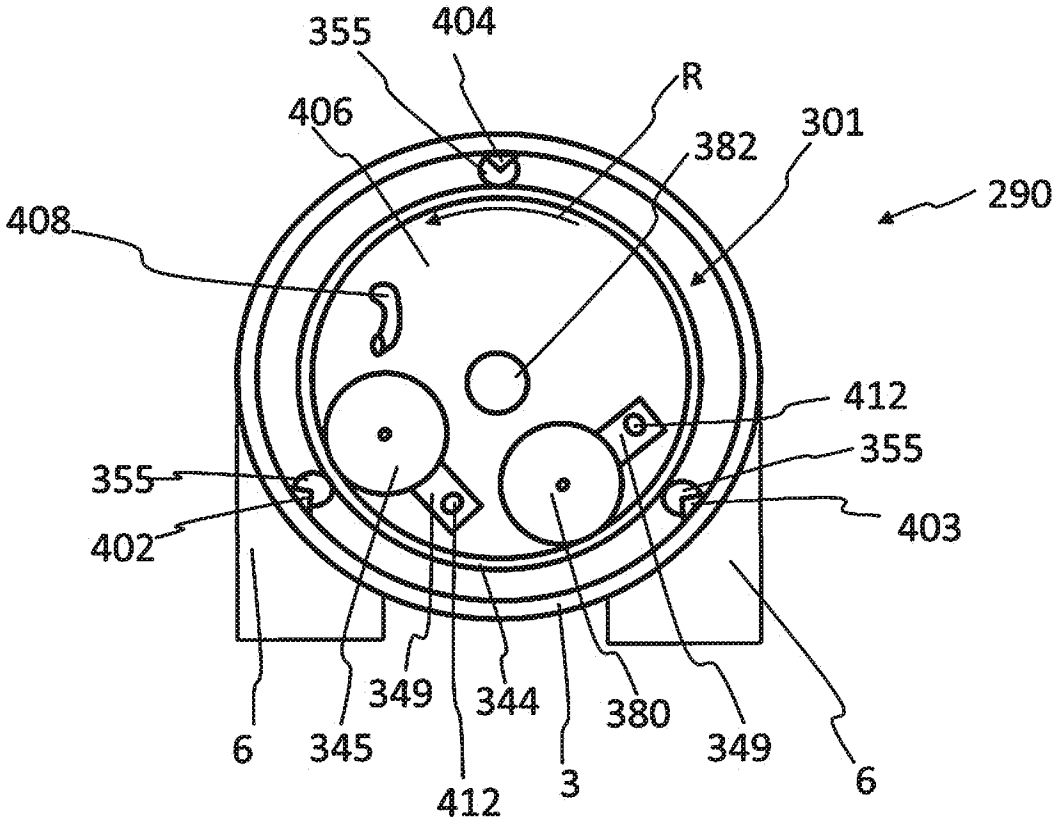
Figure 17:
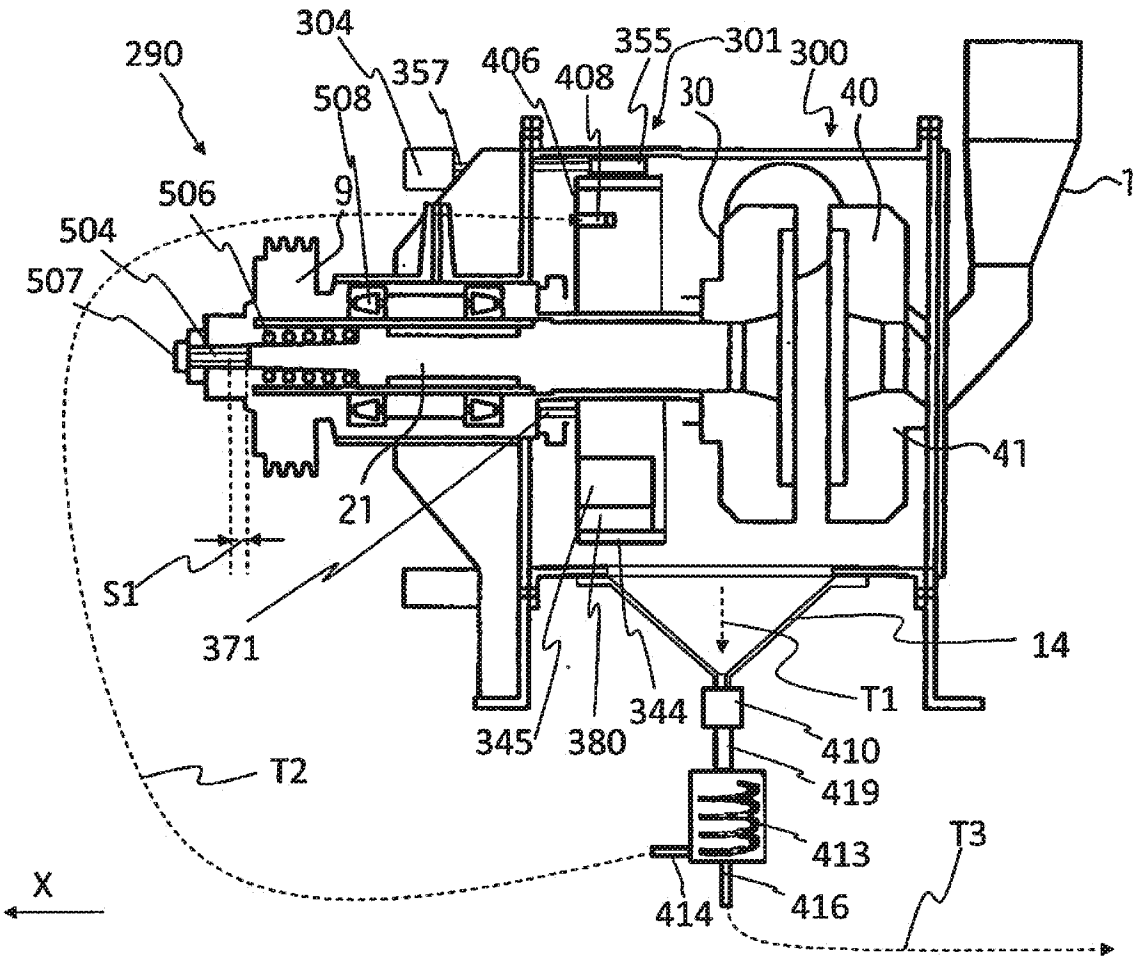
Figure 18:
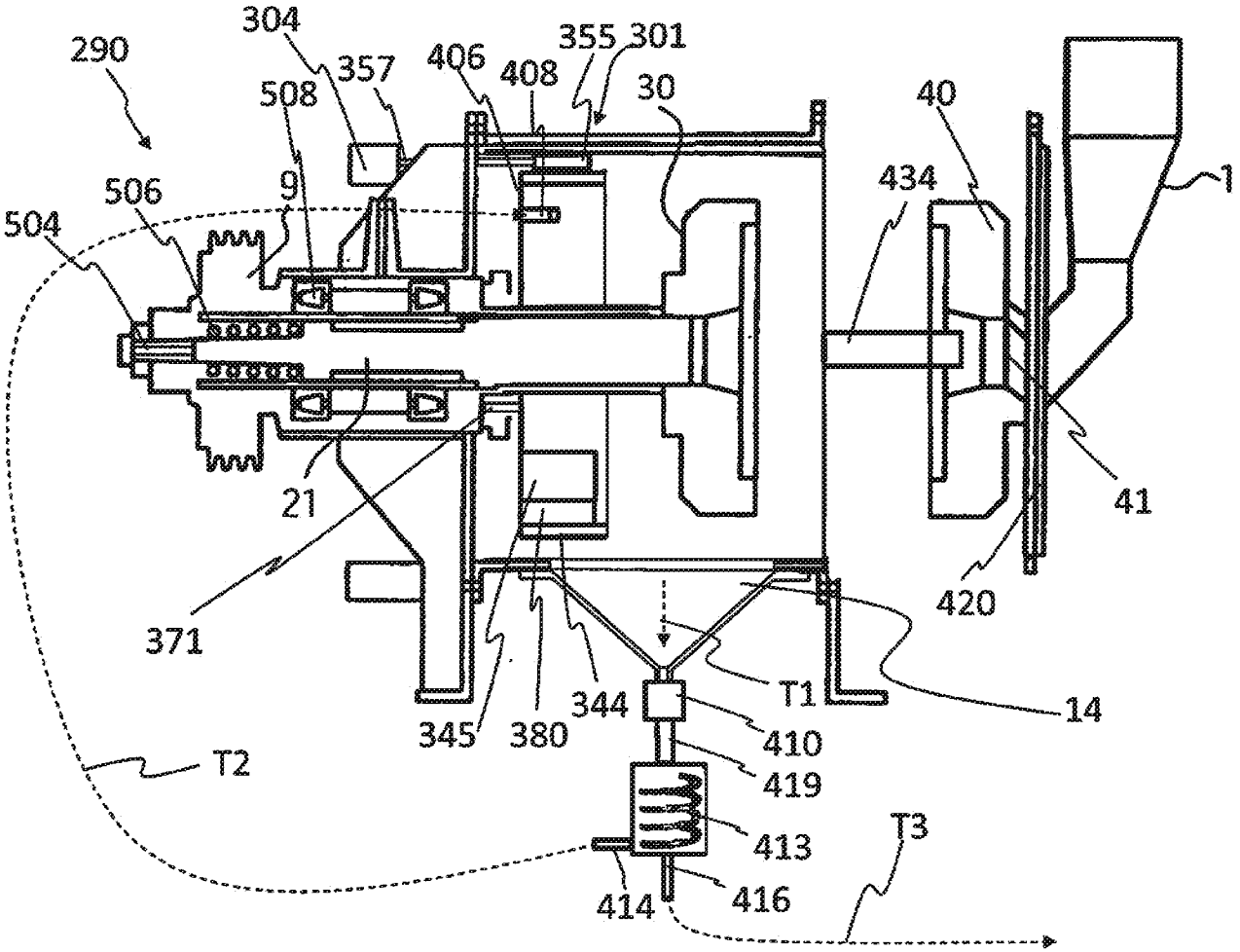
Figure 19B:
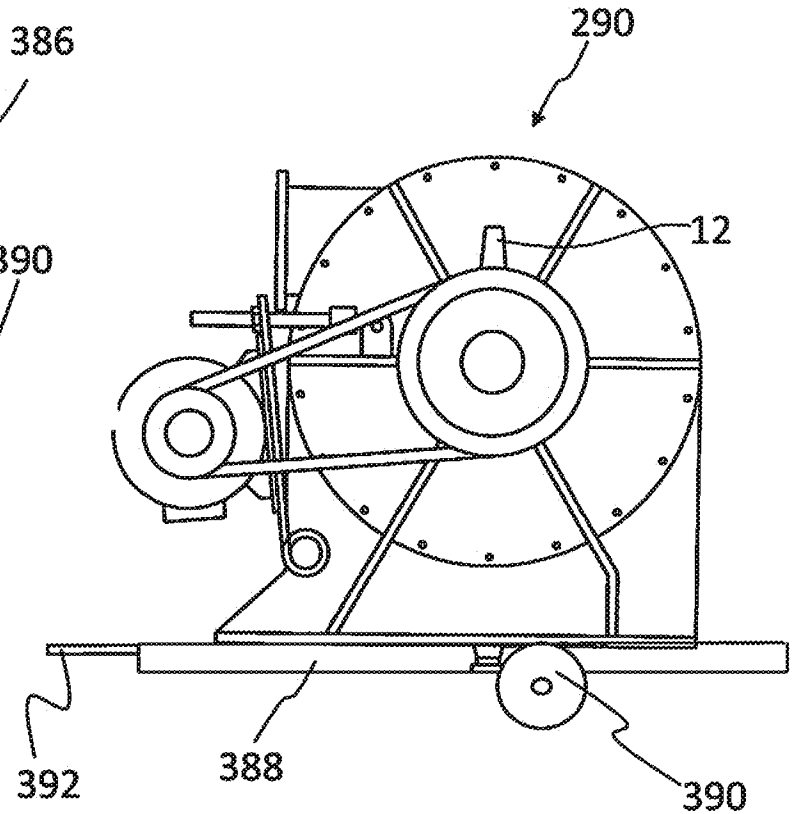
Figure 19A:
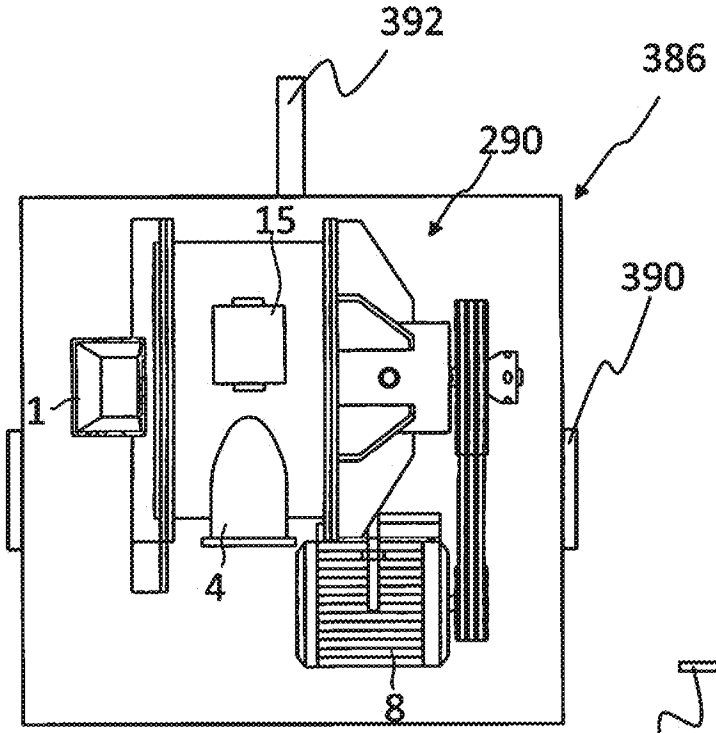
Figure 20:
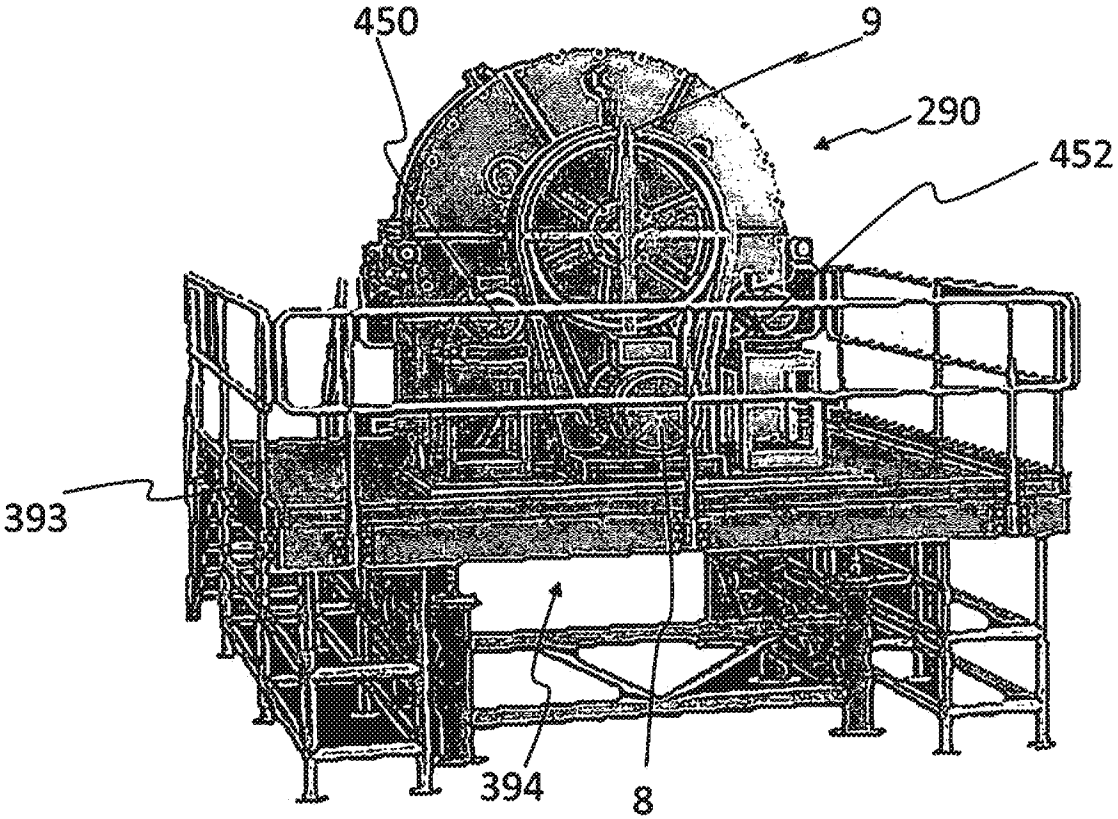
Figure 21B:
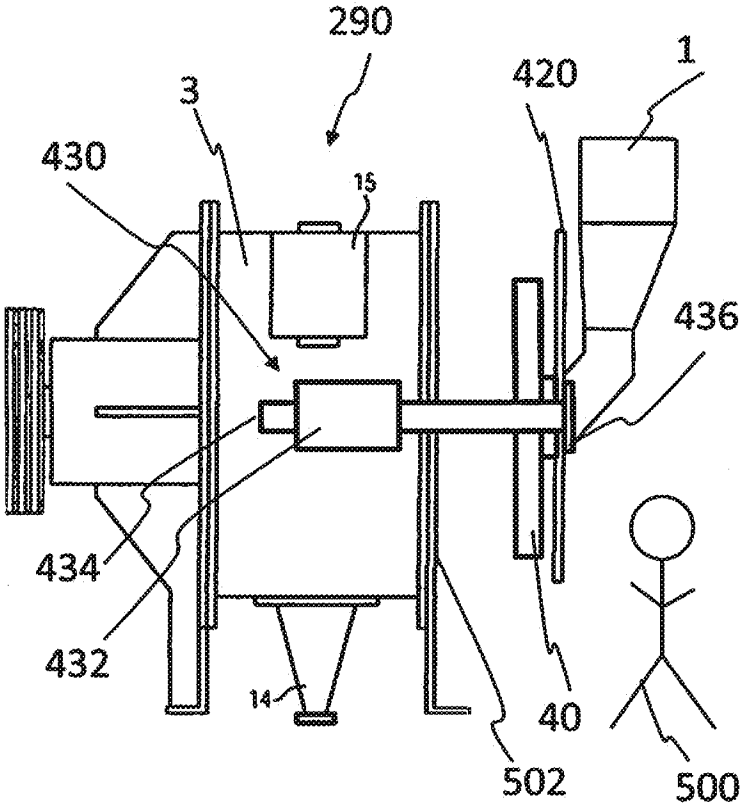
Figure 21A:
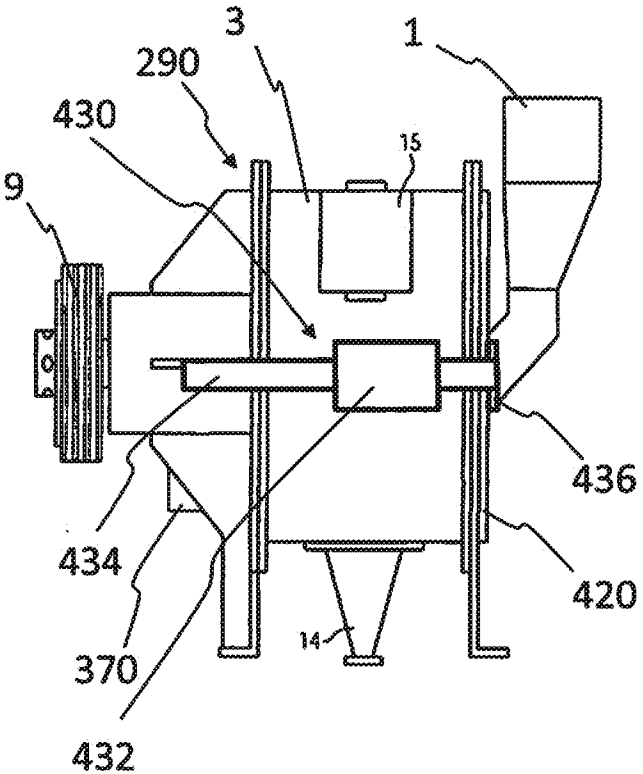

FIG. 14 shows a perspective view of the inventive device in an exploded view;

FIG. 15 shows a perspective view of a preferred embodiment of a second comminuting means of the device according to the invention;

FIG. 16 shows a schematic view of the second comminuting means;

FIG. 17 shows a schematic cross-sectional view of the ore comminuting device according to the invention;

FIG. 18 shows the illustration of FIG. 17 in an opened configuration;

FIG. 19*a* shows a schematic illustration of a device according to the invention on a transportation means in a top view;

FIG. 19*b* shows a schematic illustration of a device according to the invention on a transportation means in a side view;

FIG. 20 shows a device according to the invention on a platform;

FIG. 21*a* shows a device according to the invention in a closed configuration and with a closing means; and FIG. 21*b* shows a device according to the present invention in an opened configuration.

DESCRIPTION OF A PREFERRED EMBODIMENT

According to FIG. 1 the device according to the invention is illustrated, the ore to be comminuted respectively the slag to be comminuted being introduced into a funnel or feed funnel 1 which constitutes the ore feed unit. Alternatively, instead of a funnel a screw conveyor can also be provided which feeds the ore to be comminuted under pressure into the first comminuting means. The ore is fed through the funnel 1 to the cylinder-like housing 3 which is mounted on one foot 2 and one foot 6. The pulverisation of the ore to be comminuted takes place in this housing 3. Here a motor 8 transfers the torsional moment from the motor 8 to the pulveriser by means of a drive roller 11 and a belt 10 and a belt pulley 9.

Figure 2:
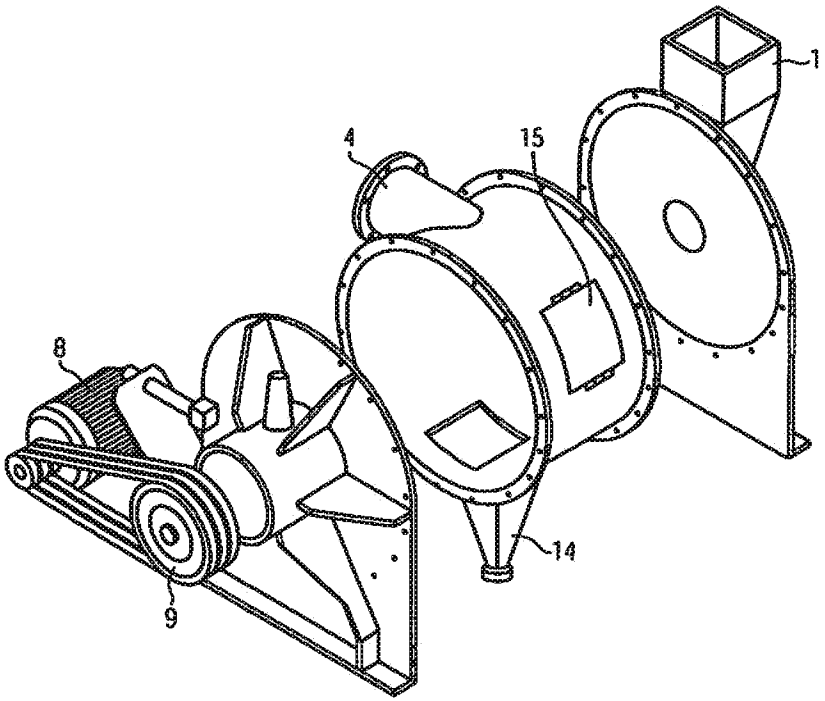
FIG. 2 shows an exploded representation of a part of the device according to the invention of FIG. 1.

As can be gathered in particular from FIG. 2, a suction opening 4 is optionally possible through which the pulverised ore can be sucked out by means of negative pressure. Alternatively, and in particular as a rule, there is provided in the lower region of the housing 3 an outlet funnel 14 which generally forms the first outlet unit. By means of this outlet funnel 14 the pulverised ore is discharged from the device according to the invention with the aid of the force of gravity or by suction.

Figure 3:
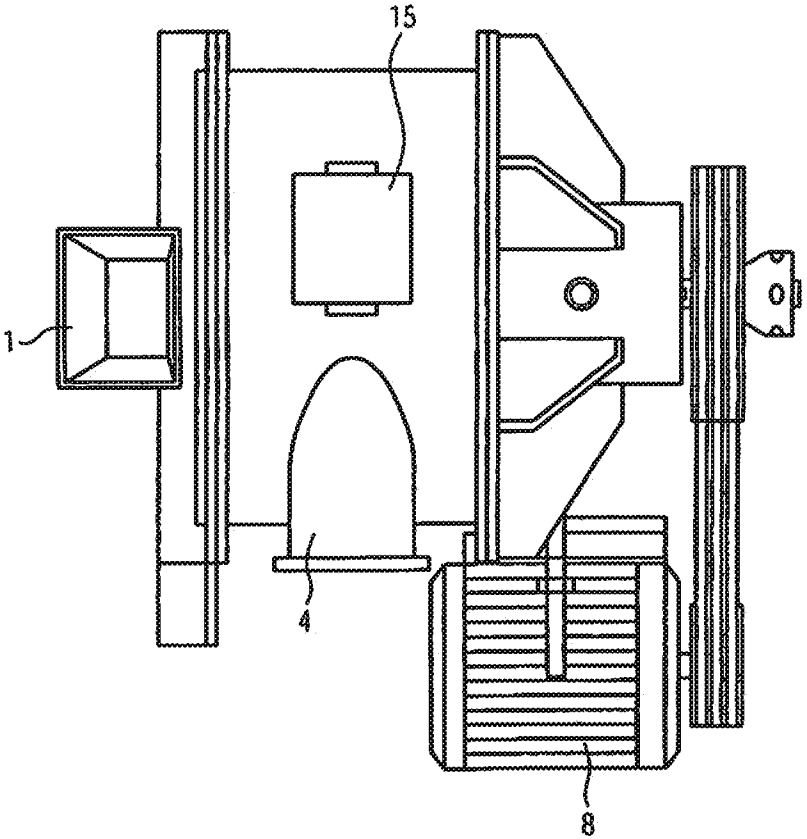
FIG. 3 shows a top view of a part of the device according to the invention of FIG. 1.

A control flap 15 can be provided on the housing 3 in order to provide, if so required, access to the interior of the housing. However, this is not necessary for the function of the device according to the invention. As can be gathered in particular from FIG. 3, the control flap 15, like the feed funnel 1, is disposed in the upper region of the device according to the invention. Furthermore, the ore can be fed in a continuously manner to the first comminuting means through the feed funnel or also in a non-continuously manner to the first comminuting means if ore or slag is only fed sporadically to the device according to the invention.

Figure 4:
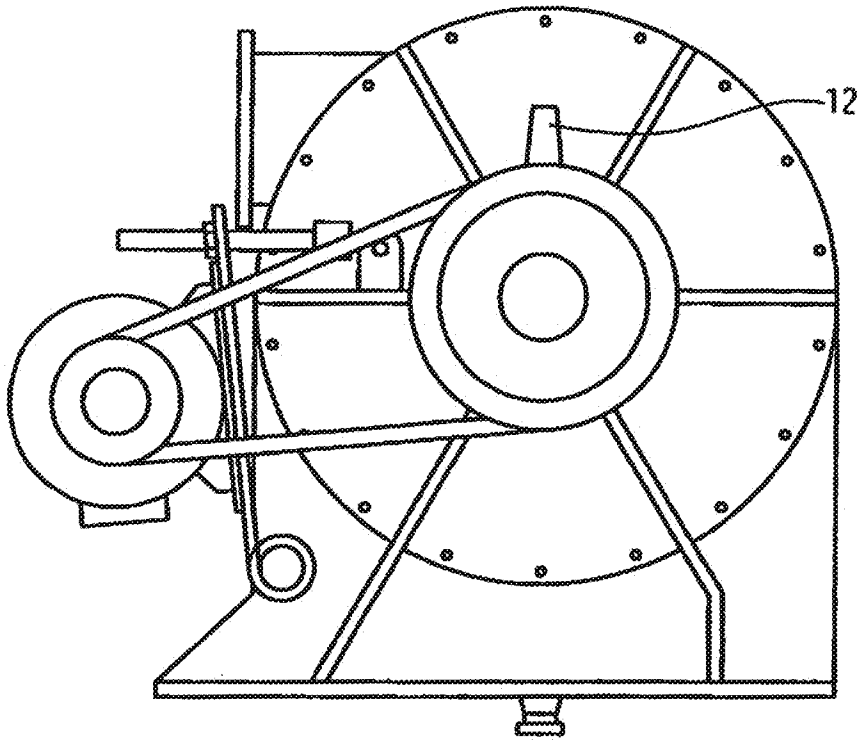
FIG. 4 shows a side view of a part of the device according to the invention of FIG. 1.
Figure 5:
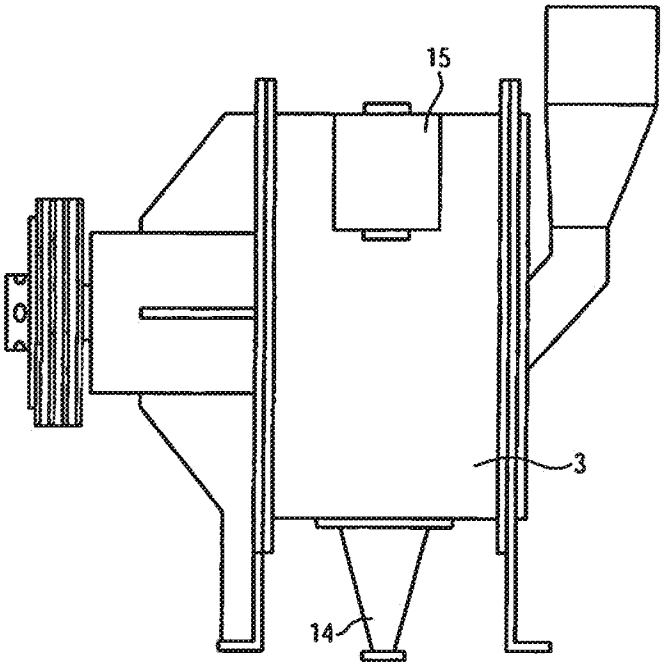
FIG. 5 shows a part of the side view of FIG. 1.

FIGS. 4 and 5 respectively show a side view of the device according to the invention from which it is evident that the outlet funnel 14 is provided in the lower region of the cylinder-shaped housing 3.

One can see in particular from FIG. 6*a* the function and the structure of the pulveriser. The belt pulley 9 is, as already described, driven by the motor 8 and transfers this torsional moment via a shaft 21 onto a comminuting element 30 which is thus rotating. In its simplest form the comminuting element 30 is designed as a rotating turning element 30 with a disc-like configuration which together with a stationary fixed element 40 forms the first comminuting means 300. As can be seen from FIG. 6 the ore to be comminuted is fed via the inlet funnel 1 into the housing 3 by a feed opening 41 being provided substantially in the centre of the fixed element. The ore fed through the feed opening 41 is now pulverised between the fixed element 40 and the rotating turning element 30 and expelled or conveyed away radially outwards in pulverised form between the two comminuting elements 30, 40 and collected within the housing 3 in pulverised form and then discharged from the outlet funnel 14.

Observing in detail the path of the material respectively rocks in the device according to the invention, thus primarily material respectively the stones get into the devices via a feed funnel. Via outlet opening in the centre of the fixed disc jaw respectively the fixed comminuting element 40 material enters the intermediate space, wherein the actuated disc jaw respectively the comminuting element 30 causes the acceleration of material respectively stoneware. Into the geometry of the disc jaws 30, 40 carrier elements are preferably integrated, which transfer the carried ore stones in a radial speed. With the gathered acceleration energy are the stones colliding with each other and that causes highly efficient comminuting of mill material.

This Micro Impact is based on accelerated material by means of a relative movement of the comminuting elements 30, 40 respectively the jaws and due to the narrowness of the intermediate space comminuting takes place in very fast time intervals. The carrying elements on the disc jaws 30, 40 ensure high speeds in radial direction as well as in axial direction, thus that as a result the generated powder is pressed outwards of the intermediate space and gets as powder via outlet funnel 14 for further processing out of the device 290. The degree of comminution—respectively the grain size—in particular defines the distance of both disc jaws respectively of both comminution elements 30, 40. The smaller the distance the finer the grain size. The work process further decreases by adding water into the mill. Therefore, the operating staff has multiple parameters for adjustment for the required grain size—and this without any dust exposure.

The device according to the invention of FIG. 6*a* is illustrated modified in FIG. 6*b*. According to this illustration a pumping means 410 is connected to the outlet funnel 14, in turn a separating means 413 is connected to the pumping means 410. The ore feeded via outlet funnel 14 to pumping means 410 is preferably accelerated and/or pressure is applied to it by means of pumping means 410 and via conduit section 419, in particular a pipe or a hose, feeded into the separating means 413. It is also conceivable, that pumping means 410 is directly respectively straight connected with separating means 413. Ore is outputted via the first outlet 414, which again shall be fed to the first comminuting means, in particular the comminuting elements 30, 40. The feeding of the ore outputted via the first outlet 414 happens preferably transport path T2, that means the ore to be further comminuted is preferably fed to feeding funnel 1. Housing 3 particular preferably comprises the first comminuting means 300 and/or the feeding funnel 1 a feeding connection 520 via which flowable substances are feedable to the first comminuting means 300. In particular ore fed via T2 is hereby considered as flowable substance. Further, feeding connection 520 can comprise multiple connection spots for coupling one or a plurality of further conducting elements. Hence, it is also conceivable that a conduit respectively a conduit element for feeding a liquid, in particular water or a water comprising liquid, is coupled via feeding connection 520 with the device 290 according to the invention. The separating means 41 preferably has a second outlet 416 from which already sufficiently comminuted ore is outputted. The sufficiently comminuted ore respectively ore which does not shall or must be fed to the first comminuting means 300, that means comminuting elements 30, 40, preferably gets according to transport path T3 directly conducted to a further processing means, in particular a second comminuting means (cf. FIG. 17) or a floating means.

Further, FIGS. 6*a* and 6*b* show a spring means 504 schematically in the area of a first axial end 521 of shaft 21. The spring means 504 can be formed e.g. as mechanical, pneumatical or hydraulic spring means and is preferably arranged between belt pully 9 and shaft 21. However, it is conceivable that the spring means 504 can be formed respectively arranged at other positions in the area of shaft 21. Reference number S1 characterizes a displacement range, on which shaft 21 is moveable respectively between which shaft 21 is variably mounted, in case shaft 21 is moved in axial direction and a deflection of spring means 504 is caused.

During a comminution of ore in the first comminuting means 300 an initial pressure application on the ore clumps yet only a little or not comminuted takes place. The pressure application is caused by a ramp region 31, which is designed volutely and formed at one or both comminuting elements 30, 40. Due to the voluted design a feeding effect is caused by a rotation of a comminuting element 30, due to which ore between the comminuting elements 30, 40, in particular between the ramp region 31 of a comminuting element 30 and a corresponding region 42 of the other comminuting element 40, is compressed respectively applied to increasing pressure. Pressure applied to ore clumps normally causes that the ore clumps are falling apart in very small pieces and therefore succumb to the pressure. In presence of ore clumps which do not succumb the generated pressure threatens to further increase, whereby the workload on the device components, in particular comminuting elements 30, 40, shaft 21, bearings 506, 508, etc. also strongly increases and can even reach a level, from which damage of single or multiple of said components is possible. Due to the inventive utilization of a spring means 504 overloading of the components in the range of the first comminuting means 300 can be prevented. There is to say, the spring means 504 deflects in case the workload is to high respectively surpasses a specific, in particular adjusted, level. Because of the deflection of spring means 504 a sliding of a comminuting element 30 results, whereby the comminuting elements 30, 40 are spaced apart from each other. After respectively during a pressure decrease between comminuting elements 30, 40 the deflected spring means 504 causes a return of the comminuting element 30 in the starting position. Due to the sliding of the comminuting element 30 a slit between the comminuting elements 30, 40 is increased, whereby larger ore particles respectively ore clumps can escape from the first comminuting means 300. All ore particles respectively ore clumps escaping from the first comminuting means 300 are fed to a separating means 413, by means of which a separation of the already sufficient comminuted particles and the not yet sufficient comminuted particles respectively ore clumps are caused. The ore particles respectively ore clumps not yet sufficiently comminuted are again fed to the first comminuting means 300 or to a second comminuting means 301.

Further, it is also conceivable that ore particles respectively ore clumps can occur in the region of comminuting protrusions 35, 45 and do not fragment in consequence of the applied pressure. Since the comminuting protrusions 35, 45 of comminuting elements 30, 40 are radially spaced apart from the centre ore particles respectively ore clumps in this region cause the generation of high momentums, which can cause damaging of the first comminuting means 300, in particular of one or both comminuting elements 30, 40, shaft 21, etc. The inventive arrangement of a spring means 504 enables preferably also in that case, that a deflection of a comminuting means 30, 40, in particular a comminuting element 30, which is coupled with shaft 21, takes place.

The inventive manner of comminuting only requires a short time due to the small floor requirements of the comminuting space, wherein the comminuted ore is fed to the outside through the intermediate space 60 between the comminuting elements 30, 40 during a rotation of the rotation element and away from both comminuting elements 30, 40, as it is e.g. illustrated by comminuted ore 55 in FIG. 7. This means, that ore clumps are comminuted by means of the relative movement in form of a rotation between the two comminuting elements 30, 40, wherein according to a further embodiment two comminuting elements 30, 40 can be used with different rotational speeds as well as equal or opposed directions of rotation.

The pulverisation is described in more detail, in particular with regard to FIG. 7. In the same way as in FIG. 6*a* the ore to be comminuted is fed via the feed opening 41, which is preferably located substantially in the centre of the fixed element preferably being formed as comminuting section 40, into a comminuting space between the fixed element 40 and the turning element 30. FIG. 7 shows by way of example several lumps of ore 50 which represent the ore to be comminuted. After the lumps of ore 50 to be comminuted come into contact through the feed opening 41 with the turning element 30, the rotation of the turning element 30 causes the lumps of ore 50 to be accelerated radially outwards and in the rotational direction of the turning element 30. For this purpose the two comminuting elements form a comminuting space, one or more accelerating elements being disposed on at least the turning element or the fixed element in order to bring about acceleration and corresponding comminution of the ore that has been fed in. By means of the rotation of the turning element 30 the ore to be comminuted is pulverised directly by the contact with the turning element 30 and also by the contact between lumps of ore which have already been partially comminuted and also by contact with the fixed element 40 in the comminuting space.

FIG. 8 shows the two comminuting elements of FIG. 7 in the opened up state together with ore 50 to be comminuted and pulverised ore 55 positioned by way of an example. The ore 50 to be comminuted is fed via the feed opening 41 through the fixed element 40 into the comminuting space between the two comminuting elements, as already described. Optionally, the turning element 30 has a ramp region 31 which has a rising incline from the start of the ramp 32 to the end of the ramp 33 and can be part of the comminuting space. By means of the rotation of the turning element 30 the ore 50 to be comminuted is already comminuted due to the rising ramp region 31, as shown diagrammatically by the spherical particles of ore 51 and 52 which become smaller and smaller. The ramp region 31 co-operates here with an annular region 42 of the fixed element 40. Next the ore is accelerated and pulverised by protrusions 35 which act as accelerating elements due to the rotation of the turning element 30 and which are arranged equal distances apart in the circumferential direction of the turning element 30 in FIG. 8. The fixed element 40 can also have protrusions 45 which are arranged in the same way as the protrusions 35 of the turning element 30. Corresponding recesses 36 are provided on the end face of the turning element 30 between the protrusions 35 of the turning element as part of the comminuting space. The protrusions 35 are in particular at a predetermined angle in the cross-over to the recesses 36 in order to accelerate the ore to be comminuted both in the radial direction according to the rotation and also in the axial direction of the axis of rotation of the turning element. In this way the ore to be comminuted is accelerated into the centre of the comminuting space and strikes against other accelerated ore elements here so that notional pulverisation is produced by the micro-impact.

Optionally, the fixed element 30 has corresponding recesses 46 between the protrusions 45 of the fixed element 30. After the ore has been pulverised between the fixed element 40 and the turning element 30, in particular by the acceleration by means of the protrusions 35, the ramp region 31 and the protrusions 45 of the fixed element due to the rotation, the pulverised ore 45 passes into the intermediate space 60 between the two comminuting elements 30, 40.

As already described, the intermediate space 60 is formed by the variable distance between the two comminuting elements 30, 40, in addition to the variable distance star-shaped outlet notches 61 leading away from the axis of rotation of the turning element 30 also possibly being provided in the turning element 30. Similarly, outlet notches 62 are provided equal distances apart in the fixed element 40. As shown diagrammatically with regard to the turning element 30 in FIG. 8, the pulverised ore 44 is discharged outwards through the outlet notches 61 and 62. If the distance between the turning element 30 and the fixed element 40 is not provided, i.e. the two elements are substantially resting against one another, the pulverised ore 55 is substantially discharged outwards through the outlet notches 61 and 62. The variable distance between the two comminuting elements can be adjusted in particular by a hydraulic unit, and preferably the fixed element 40 can be positioned variably in the axial direction in relation to the turning element 30 in order to be able to adjust the pulverisation as regards size and composition, in particular for a different ore.

According to a further embodiment the fixed element 30 or the turning element 40 or both comminuting elements can be separated from one another hydraulically in the axial direction for repair and fitting work. Alternatively, the comminuting elements can be moved apart from one another out of the operating position by means of a pivot movement of one of the two comminuting elements. In this way the accelerating elements 35, for example, or other elements of the first comminuting means subjected to high mechanical stress can be worked on or replaced. Furthermore, this makes it possible for elements subjected to high mechanical stress within the first comminuting means or for example the accelerating elements of protrusions 35 to be able to be made of different materials and to be exchanged as required. In this way wearing parts within the comminuting space, such as for example the protrusions, can also be further adapted to different ores.

With regard to FIG. 6, which shows a diagrammatically enlarged distance between the turning element 30 and the fixed element 40, it is evident that with only a small distance the ore to be comminuted is thrown outwardly in the radial direction by the rotation and is contained by the housing 3 before the pulverised ore is discharged from the device 290 according to the invention via the outlet funnel 14, for example by the force of gravity alone or additionally by a suction device or similar.

FIG. 9 shows a further embodiment of a fixed element 140 which has a feed opening 141 in the centre. The fixed element 140 is substantially identical to that of FIG. 8, the fixed element 140 having outlet notches 162 set at an angle through which the pulverised ore is conveyed away to the outside.

In the form illustrated the fixed element 41 shown in FIG. 9 can also be used as a second turning element which can have a relative speed different to the turning element 30 illustrated in FIG. 8.

The embodiment of a comminuting element shown in FIG. 9 has an angular region 144 which extends respectively to both sides from the accelerating element 143 to the recess 145. However, these two angular regions 144 can also be provided on just one side of the accelerating element 143 depending on the rotational direction in order to accelerate the ore to be comminuted, depending on the direction of rotation of the comminuting element, both in the radial and in the axial direction in relation to the rotation of the comminuting element. In this way, together with the accelerating elements of the turning element 30 shown in FIG. 8, particularly effective pulverisation can be produced, in particular when the accelerating elements of the turning element 30 also have an angular region which is congruent to the angular regions 144 of the comminuting element of FIG. 9 or are arranged substantially in a mirror image of one another.

FIG. 10 shows a cross-section of the fixed element 40 of FIG. 8, the feed opening 41 having a funnel-shaped structure.

According to FIG. 11 a further embodiment of the comminuting elements according to the present invention is shown.

Alternatively to the comminuting elements according to FIGS. 7 to 10, in FIGS. 11 to 13 further embodiments for co-operating comminuting elements are shown which can be arranged within the device according to the invention according to FIG. 6.

In FIG. 11 a fixed element 240 and a rotating turning element 230 are shown, the ore 50 to be comminuted being fed via the feed opening 241 into the comminuting space between the fixed element 240 and the turning element 230. As can be seen, furthermore, from FIG. 11, the comminuting space between the fixed element 240 and the turning element 230 is formed such as to taper substantially conically outwards from the axis of rotation of the turning element 230, by means of which on the one hand pulverisation of the ore is brought about. On the other hand it is evident from FIG. 12 that the turning element 230 has recesses 236 which are arranged equal distances apart around the axis of rotation of the turning element. By means of the cross-overs of the recess 236 arranged at an angle, these recesses 236 provide in particular acceleration and so pulverisation of the ore due to the rotation which provides a relative movement between the turning element 230 and the fixed element 240.

FIG. 13 shows the fixed element 240 of FIG. 11 which co-operates with the turning element 230 of FIG. 12. The fixed element 240 shows in the cross-section in FIG. 13 the feed opening 241. Similarly to the turning element 230 the fixed element 240 has recesses 246 in the radial direction around the centre of the axis of rotation. In particular, the sloped regions of the recesses 236, 246 of the turning element 230 and the fixed element 240 provide acceleration and comminution of the ore which is discharged outwards in pulverised form through the intermediate space 260 between the turning element 230 and the fixed element 240.

According to the invention a method for comminuting ore and/or in particular slag is thus provided, the ore feed unit 1 being provided for feeding ore 50 to be comminuted to a first comminuting means. The first comminuting means is composed of at least two comminuting elements 30, 40 that can be moved relative to each other, which elements form a comminuting space for the ore to be comminuted with each other such that by a relative moment in the form of a rotation of at least one of the two comminuting elements 30, 40 the ore to be comminuted is pulverised in that one or more accelerating elements, in particular protrusions, are provided on at least one of the comminuting elements 30, 40, said accelerating elements being arranged in particular on the end face of one of the two comminuting elements 30, 40, and accelerating and comminuting the ore to be comminuted by the rotation of one of the two comminuting elements 30, 40. Between the two comminuting elements 30, 40 and/or in at least one of the two comminuting elements an intermediate space 60 is provided through which during the rotation the pulverised ore is conveyed away outwards from the centre of the rotation or from the axis of rotation of the turning element and from the two comminuting elements 30, 40. The ore pulverised in this way between the two comminuting elements is discharged outwards through a outlet unit which is at least functionally connected to the intermediate space 60.

Purely optionally, during the comminuting process water can also be fed into the comminuting chamber through a water inlet (not shown) or by feeding water through the ore feed unit. The water thus forms together with the ore during and after pulverisation a sludge-like compound, the water being conveyed away through the outlet unit together with the pulverised ore.

As already explained with regard to FIG. 8, the ramp region 31 is particularly advantageous for the comminuting of slag because such a ramp region on the turning element provides pre-comminution of slag by means of the rotation of the turning element, protrusions and/or recesses being provided according to the invention in the comminuting elements after the ramp region in the direction of conveyance in order to pulverise the particularly brittle and hard slag.

For the person skilled in the art it is quite obvious that the number of protrusions on the two comminuting elements can respectively be equal, it also being possible, however, to provide a different number of accelerating elements on the two comminuting elements.

According to one embodiment (not shown), the two comminuting elements can rotate in opposite directions in order to increase the relative movement between the two comminuting elements. However, this leads to greater structural complexity, and is only to be implemented in special cases.

In particular, the shape of the comminuting chamber which is formed by the two comminuting elements can be of different designs, different types of accelerating element being able to be arranged in plate-shaped or wedge-shaped or some similar form by means of which the ore to be comminuted is accelerated and so pulverised between the two comminuting elements.

According to one embodiment (not shown), in addition to the comminuting between the two comminuting elements, a further comminuting chamber can also be provided which is provided independently of the two comminuting elements, but is however integrated into the device according to the invention.

A device according to the invention and a method according to the invention for comminuting ore and/or in particular slag are thus described which comprise an ore feed unit for feeding ore to be comminuted to a first comminuting means, the first comminuting means being composed of at least two comminuting elements that can be moved relative to each other, which elements form at least one comminuting space for the ore to be comminuted with each other such that, by a relative movement in the form of a rotation of at least one of the two comminuting elements the ore to be comminuted is pulverised in that one or more accelerating elements, in particular protrusions, are provided on at least one of the comminuting elements, said accelerating elements being arranged in particular on the end face of at least one of the two comminuting elements and accelerating and comminuting the ore to be comminuted by the rotation of one of the two comminuting elements, and there being provided between the two comminuting elements and/or in at least one of the two comminuting elements an intermediate space through which during the rotation the pulverised ore can be conveyed away outwards from the centre of the rotation and from the two comminuting elements, and an outlet unit, in particular an outlet unit, being provided which is connected to the housing of the device through which the pulverised ore is discharged.

An exploded view of the device 290 according to the invention is depicted in FIG. 14. This illustration shows, that the device 290 comprises in the region of a first comminuting means 300 a feeding means 1, in particular a feeding funnel 1, by means of which ore to be processed is conductable into housing 3 to the first comminuting means 300. The housing 3 is preferably by means of two plate-like formed feets 2, 6 with respect to the underground positioned respectively coupled with a preferably on the underside of the housing 3 arranged frame element 305. Housing 3 of the first comminuting means 300 preferably has an opening 4, in particular a suction opening 4 for sucking off of already comminuted ore. Further, underneath housing 3 respectively in the lower region of housing 3, that means preferably in the region underneath the first comminuting means 300 and/or underneath the second comminuting means 301, an outlet unit 14 (cf. FIG. 17) is formed.

Reference number 340 preferably characterizes a hydraulic means (cf. FIG. 20 a/b).

The second comminuting means 301 is preferably formed laterally beside the first comminuting means 300. The first comminuting means 300 and the second comminuting means 301 are arranged on the same frame element 305. A wall of housing 306 of housing 3 is preferably on a first site coupled with the first comminuting means 300 and on another side with the second comminuting means 301. The wall of the housing 306 preferably comprises multiple fixing locations 354, 381 for arranging, receiving and/or fixing of a first means 302 for fixing and/or mounting of a preferably as mill ring 344 formed rotation body, a second means 303 for fixing and/or mounting of the mill ring 344 and a third means 304 for fixing and/or mounting of the mill ring 344. Mill ring 344 is due to movement means 302, 303 and 304 preferably movable mounted and actuatable. Further, mill ring 344 surrounds in radial direction preferably at least one further rotation body 345 and particular preferably at least or exactly two rotation bodies 345, 380, which are particular preferably formed as drum-like bodies. Further, in the wall of the housing 306 preferably an opening 382 is formed. The first opening 382 particular preferably serves for putting through the shaft, which is provided for actuating comminuting element 30.

The first means 302 and the second means 303 are preferably formed identical and in vertical direction preferably arranged underneath a centre of the mill ring 344. Means 302, 303 can also be considered as axes or movable shafts 371,313. Each one of the first means 302 and the second means 303 preferably comprises an element for the application of force, in particular a drive wheel 367. The actuating elements 367 are preferably mechanically coupled with each other and therefore at the same time respectively synchronous movable respectively actuatable. In axial direction are preferably joined to the drive wheel 367 a disc element 364, a fixing body 366, a fence element 36, bearings and/or one or multiple receiving bushs, by means of which the axes respectively shafts 371, 313 are preferably directable into a functional connection.

A drive wheel 367 of a means 302, 303 is preferably immediately or mediatly connected with a further actuating element 368, in particular a gear for transferring actuation forces. Gear 368 is preferably connected via an endless element 369, in particular a chain or a belt, with a further actuating element, in particular a further gear 368, which is preferably directly arranged at an actuating means, in particular a motor 370. However, it is also conceivable, that motor 370 directly interacts with one of the drive wheels 367 respectively is arranged thereon.

The third means for fixing and/or transmission of force 304, which is preferably considerable as upper axis respectively shaft 357, is preferably arranged above the centre of mill ring 233 and particular preferable arranged in vertical direction exactly above the centre of mill ring 344. The third means 304 preferably has a disc element 365, a fixing body 363, an inner cover element 362, a bolt nut 360, a washer 359, bearings 358 and/or one or more receiving bushs 355 by means of which the axis respectively shaft 367 is preferably directable into a functional connection with mill ring 344.

The first means 302, the second means 303 and/or the third means 304 are preferably essentially or exactly aligned in parallel with respect to each other, wherein preferably at least one of those means 302, 303, 304 is also essentially or exactly aligned in parallel to the rotation axis of a comminuting element.

Further due to reference number 307 a forth means for fixing and/or transmitting of forces is characterized. The forth means 307 preferably serves for alignment respectively holding of the rotation body 345, 380 with respect to mill ring 344. However, it is also conceivable that the forth means 307 comprises an actuation means for active actuation of one respectively the rotation bodies 345, 380 receptively is coupled with such an actuating means. The forth means 307 preferably can be considered as axis or shaft 351 and preferably comprises an outer cover element 354, a fixing means 366, an inner cover element 352, a spacing element 348 for receiving and/or spacing the axes 347, bearing cover elements 348, axes 347 and/or roller bearings 346. The rotation bodies 345, 380 are therefore rotatable mounted by bearings 346.

FIG. 15 shows a perspective illustration of parts of the second comminuting means 301. According to this illustration the second comminuting means 301 has a rotation body formed as mill ring 34, which at least sectionally and preferably completely surrounds radially two further rotation bodies 345, 380, which are formed as drum-like mill elements respectively mill-drums. Mill ring 344 and mill drums 345, 380 have axially preferably essentially the same length, wherein it is also conceivable, that mill drums 345, 380 implemented axially longer as mill ring 344 respectively vice versa. Mill drums 345, 380 preferably comprise an outer surface 383, which is preferably formed spherically, in particular starting from its essentially axial center to its axial ends conical tapered. The inner surface 383 of mill ring 344 is preferably formed cylindrical, wherein it is also conceivable that it is formed negative or essentially negative with respect to the outer surface 383 of mill drums 345, 380 The outer surface 384 of mill ring 344 is preferably formed cylindrical. The outer surface 384 of mill ring 344 are contacting preferably exactly three means 302, 303, 304 for fixing and/or force transmission, in particular respectively by means of element 55 for guiding mill ring 344, preferably in line contact and particular preferably in areal contact.

Reference number 348 preferably characterizes a bearing cover, which preferably covers at least sectionally radially the drum body of mill drum 380 and the bearing, which preferably consists of preferably at least or exactly two roller bearing 346 (cf. FIG. 14), in particular covers in such a manner, that the bearing is protected against the entering of ore powder.

The rotation axes of both mill drums 344, 380 are preferably arranged spaced apart by means of a spacing element 349. The spacing element 349 is preferably formed as strut shaped, in particular plate shaped, receiving element, in particular out of metal. Beside the mill drums 345, 380 a fixing body 366 is preferably also arranged at the spacing element 349 respectively coupled with the spacing element 349. Hereby the fixing body 366 can be provided for one-sided attachment of mill drum units 345, 380, 348, 349 at a housing part (not shown), in particular a further wall of the housing. However, it is also conceivable that fixing body 366 is formed as actuating unit 366 and serves for active actuating of mill drums 344, 380.

The first means for fixing and force transmission 302 and the second means for fixing and force transmission 303 have gears 367, which are connected with each other by means of a chain 360. It is further obvious, that the second means for fixing and force transmission 303 is also equipped with a round disc-like force transmission plate 368, which is radial formed for receiving a belt 372, by means of which the second means for fixing and force transmission 302 is coupled with a further round force transmission plate 368, which again is connected with an actuating means 370, in particular a motor for operating the second comminuting means 301.

A cross-sectional view through the ore comminuting device 290 according to the invention is shown in FIG. 16*b*. The device housing 3 is gatherable from this illustration, which is held by means of feats 6 with respect to the underground respectively a receiving rack (cf. FIG. 19 or FIG. 20*a/b*). Housing 3 preferably surrounds the second comminuting means 301 in circumferential direction completely. On the inner surface of housing 3 respectively on the surface side facing the second comminuting means of the housing preferably multiple holding means are arranged, in particular exactly three holding means namely a first holding means 402, a second holding means 403 and a third holding means 404. The holding means 402, 403, 404 preferably serve for positioning respectively holding of actuating and/or guiding elements 355. The actuating and/or guiding elements 355 are preferably rollers, which are arranged rotatable at the holding means 402, 403, 404. At least one of the actuating and/or guiding elements 355 is preferably actuated by means of a motor. Particular preferably two or all actuating and/or guiding elements 355 are actuated, in particular by means of a motor or by means of a respective motor. The actuating and/or guiding elements 355 serve for actuating and guiding of mill ring 344. Mill ring 344 is preferably adjacent to the wall of housing 406. The wall of housing 406 preferably comprises a central opening 382, which is provided for through putting of an actuating means, in particular a shaft, for actuating the first comminuting means 300, in particular of comminuting element 30 (cf. FIG. 6 and FIG. 17). Further, a feeding means 408 is formed within the wall of housing 406 respectively feeding means 408 is preferably designed tubular and extends through wall 406. The feeding means 408 preferably serves for feeding of material already comminuted by the first comminuting means 300. The feeding means 408 preferably extends in such a manner inside housing 3 respectively into a region surrounded by mill ring 344, that the material fed by means of the feeding means 408 is inserted before the first mill drum 345. Mill ring 344 preferably rotates in the direction characterized with reference sign R, whereby the material introduced before the first mill drum 345 is fed between mill ring 344 and mill drum 345. The material is further comminuted respectively pulverized due to the interaction of mill ring 344 and mill drum 345. Further, a second mill drum 380 is shown, it is therefore conceivable that multiple mill drums 345, 380 are installed. It is preferably conceivable that any number of mill drums 345, 380, in particular exactly, more or less than one, two, three, four or five mill drums, are installed. The individual mill drums 345, 380 are preferably rotatable and particular preferably active actuated by means of an actuating means. Further it is conceivable that mill drums 345, 380 are rotated respectively actuated only passive, that means as a result of a rotation of mill ring 344. The mill drums 345, 380 are preferably arranged at the wall of housing 406 by means of spacing elements 349 for receiving the mill drums 345, 380 via coupling locations 412. It is hereby conceivable that the positions of mill drums 345, 380 are adjustable respectively modifiable by means of spacing elements 349. A distance, in particular a maximum distance, of the outer mill drum surface to the inner mill ring surface is preferably adjustable.

It is further conceivable, that mill drums 345, 380 or one of those mill drums 345, 380 is spring loaded respectively is pressed againsted the mill ring respectively is pretensioned.

A ore comminuting device 290 according the invention is shown in FIG. 17 broadend with respect to FIG. 6*a* by the second comminuting means 301. The ore comminuting device 290 comprises a feeding funnel 1 via which coarse material to be comminuted is inserted into the device. The material is comminuted by means of the first comminuting means 300, in particular by means of interacting elements 30, 40, that means comminuting element 30 and fixing element 40. The comminuted material parts are moved outwardly from the region between the elements 30, 40, in particular by means of gravitation, and get to a funnel 14. The elements 30, 40 are preferably arranged with respect to each other in a distance of essentially, exactly or at most 7 cm and further preferred in a distance of essentially, exactly or at most 5 cm and particular preferred in a distance of essentially, exactly or at most 3.5 cm. Hereby it is conceivable that the distance between the elements 30, 40 is adjustable, in particular variable. The distance between elements 30, 40 can be particular preferably stepless or in predefined steps adjusted. Funnel 14 conducts the comminuted material according to arrow T1 via a pumping means 410 in a separator respectively in a separating unit 413. Separator 413 divides, in particular cyclone-like, sufficiently crushed material parts from not sufficiently crushed material parts. Not sufficiently crushed material parts, which are separated from the sufficiently crushed material parts by separator 413, are outputted from the separator 413 via a first outlet opening 414 or a junction and according to the feeding line characterized by reference sign T2 fed to an inserting means 408 (cf. FIG. 16). Inserting means 408 is preferably arranged in the region of wall 406 and serves for inserting of material parts to be further comminuted into the second comminuting means 301. Additionally or alternatively it is also conceivable that the material parts to be further comminuted are again fed to the first comminuting means 300. Reference number 416 characterizes a second outlet opening respectively a further junction. By means of the second outlet opening 416 respectively by means of the further junction sufficiently comminuted ore is channeled of respectively conveyed according to feeding line T3 out of the region of device 290, wherein the ore is preferably immediately fed respectively conducted to a floating means. It is further conceivable that separator 413 comprises three outlet unit and assignes the comminuted material to three ranges of material size, wherein the already sufficiently comminuted material is fed according to T3 and the not sufficiently comminuted material is separated into a coarse portion and a fine portion. Then, the coarse portion is again feedable to the first comminuting means 300 and the fine portion is feedable to the second comminuting means 301, in particular according to T2.

The sufficiently comminuted, in particular pulverized, material parts are discharged from the ore comminuting device according to the arrow characterized by reference sign T3 and particular preferable immediately fed to a floating means.

It is gatherable from this illustration that at least two shafts 357, 371 are provided. Shafts 357, 371 serve for actuation of the elements for guiding and/or actuating 355. The individual shafts 357, 371 are preferably connected with actuating means 304. Further a third shaft (cf. FIG. 14) for actuating a third element for guiding and/or actuating 355 (cf. FIG. 15) is particular preferably provided.

Further, mill drums 345, 380 are illustrated, which are surrounded in circumferential direction by the mill ring.

Further, reference number 504 characterizes a spring means, which can be e.g. formed as mechanical pressure spring respectively coil spring, gas spring or as hydraulic spring. The spring means 504 causes that a force of several tons is axially applied to shaft 21 and therewith the comminuting element 30. This means that an axial sliding of shaft 21 in X-direction happens only then, if e.g. as a result of a material jam forces are generated between comminuting elements 30, 40, which are directed into X-direction and exceed the spring force. The spring means 504 therefore causes in beneficial manner, that shaft 21 and comminuting elements 30, 40 are in X-direction only subjected to a predefined respectively adjusted maximum force, whereby those elements are protected against damage. The sliding path S1 of shaft 21 due to a displacement of spring means 504 preferably is in the range of a few respectively several millimeters up to a few respectively several centimeters.

Further is conceivable that the spring force is adjustable respectively predefinable in such a manner, that defined ore particle sizes are generatable. The smaller the spring force, the larger are the resulting sizes of the ore particles.

The spring force is preferably stepless respectively continuously or in steps adjustable.

Reference numbers 506 and 508 characterize roller bearings, by means of which shaft 21 is preferably mounted. Roller bearings 506 are preferably formed as ball bearings and roller bearings 508 are preferably formed as cone bearings or needle bearings.

FIG. 18 shows the embodiment of FIG. 17 in an open configuration. In this configuration preferably at least the comminuting element 30 and preferably the complete internal space of device 290 is accessible to a human for maintenance work. The housing cover 420 is thereby moved by means of an actuator 434 respectively by means of multiple actuators, in particular exactly two actuators 434, of a hydraulic means (cf. FIG. 21*a/b*) into the opened position.

A transportation means 386 is shown in FIG. 19*a* in a top view, on which a comminuting device 290 according to the invention is arranged. Transportation means 386 is preferably formed as trailer, which can be pulled by a motor driven vehicle. Transportation means 386 therefore comprises a frame 388 on which the comminuting means 290 is preferably permanently arranged. However it is also conceivable that comminuting means 290 is detachable coupled with transportation means 386. On frame 388 are preferably at least or exactly two wheels arranged for each axis. In the illustrated embodiment transportation means 386 comprises exactly one axis, wherein it is conceivable that it comprises multiple, in particular two or three axes. Transportation means 386 is coupleable via coupling location 392 with a vehicle or a further trailor.

In FIG. 19*b* a sideview of the illustration shown in FIG. 19*a* is depicted.

In FIG. 20 a comminuting device 290 according to the invention is arranged on a pedestal 393. However, in place of pedestal 393 comminuting device 290 can be arranged alternatively on a scaffold or a platform. The arrangement shown in FIG. 20 is beneficial since the outputting region 394 from which the comminuted material is outputted is easily accessible because of the distance between comminuting means 290 and the underground.

Further, the actuating means respectively the motors are characterized by reference numbers 450, 452, by means of which rotation ring body 344 (cf. FIG. 15) is actuatable.

FIG. 21*a* shows the device 290 according to the invention in a closed configuration. In this closed configuration the housing cover 420, which is in contact with the feeding funnel 1, lies, in particular sealingly, on the housing 3. The housing cover 420 is preferably holded by means of a closing means 430, which is particular preferably formed as hydraulic means, and preferably pressed against housing 3. The hydraulic means 430 preferably comprises a stator 432, which is particular preferably arranged in the region of housing 3 or on housing 3. Stator 430 is preferably coupled with the actuator 434 in such a manner, that it is slideable in the direction of extention of the rotation axis of comminuting element 30. On both sides of housing 3 a hydraulic means 430 is preferably arranged. Further, it is conceivable that the mentioned hydraulic means are also arranged in the region of the upper and lower wall regions of housing 3. It is also conceivable that more than two, in particular three or four, hydraulic means 430 are provided, in particular in the upper and lower housing region and in the lateral housing regions. In case of multiple hydraulic means 430 these are preferably simultaneously, in particular via a control means, selectable. Actuator 434 is preferably coupled respectively connected with housing cover 420 by means of an actuator-housing-cover-coupling-location 436.

Device 290 is illustrated in FIG. 21*b* in an open respectively opened configuration. The open respectively opened configuration is thereby characterized that housing cover 420 is at least sectionally removed respectively spaced apart from housing 3. Such spacing apart can take place as shown, that means housing cover 420 can in total be spaced apart from housing 3 about a preferably defined path. Spacing apart preferably takes place by means of one or multiple hydraulic means 432. However it is also conceivable that housing cover 420 lies on the one hand side on the housing 3 and is pivoted by means of the locking means respectively holding means 430 around a contact point.

The feeding funnel 1 and the comminuting element 40 are preferably arranged at housing cover 420. By means of feeding funnel 1 the ore to be feeded is preferably funnelable through housing cover 420 and through comminuting element 40 into the closed housing 3 (cf. FIG. 21*a*).

Further the illustration of FIG. 21*b* show as a human characterized by reference number 500. It can be further gathered from this illustration, that by means of hydraulic means 432 the housing cover 420 with the thereon arranged means, in particular the comminuting element 40, is particular preferably movable that far, that a human 500 can access the device through opening 502 resulting from the movement of the housing cover respectively can maintain single or all components therein. As maintenance work wear elements, like e.g. the ramp region 31, the protrusions 35, the protrusions 45 of both comminuting elements 30, 40, can be exchanged.

Hydraulic means 432 can serve additionally or alternatively as spring means for variable mounting of comminuting element 40.

The device according to the invention has procedural benefits in dry and/or wet processing. In this context a process independence from water is important. The device according to the invention works dry as well as wett—a benefit, which the process chain of crushers and mills has to differentiate according to the function. Further crushes the Micro Impact Mill also slag or a mixture of slag and ore material, which overcharges the crushing technique of classic facilities due to the hardness of the material.

It is further beneficial, that this device can process rocks and/or slag. Even bricks of furnaces do not affect it. In view of the scope of performance the device according to the invention can even replace the overall process chain consisting of crushers and ball mills. Rocks preferably with up to 80 cm, further preferably with up to 50 cm and particular preferably with up to 40 cm are directly processed suitable for flotation in one process step. This is faced with multiple crushing stages with crushers until the ball mills are in charge.

Due to the micro impact in particular only small wear takes place in the device according to the invention, that means due to the repetitive collision of ore differently accelerated, whereby the mechanical elements are only subjected to small load, wherein also no further loose milling elements or iron balls have to be used.

Furthermore, the device according to the invention and the method according to the invention enables that slag itself or together with ore material can be comminuted and pulverized, since due to the small dimensions of the comminuting space as well as the relative small dimensioned comminuting elements with a respective rotation high forces are applied on the ore material to be comminuted respectively the slag to be comminuted and thus an effective comminuting takes place. Due to the rotation, which comprises because of the dimensions 100 up to more or less 2000 revolutions per minute of a comminuting element, also slag can be pulverized in an effective manner, which is very brittle and comprises a hard structure.

With the device according to the invention the productivity of resources as well as the conserving of resources can be enhanced. With this innovation there is no need for pre-crushing with crushers and mills—in a very energy efficiency and ecological manner. This innovative device is further beneficial, because it connects energy and resource efficiency and simultaneously provides a totally new human-machine-cooperation completely without silicosis and noise-induced deafness.

LIST OF REFERENCE NUMBERS

1 Feeding funnel
2 Foot
3 Housing
4 Suction opening
6 Foot
8 Motor
9 Belt pulley
10 Belt
11 Drive roller
14 Outlet funnel
15 Control flap

21 Shaft
30 Comminuting element
31 Ramp region
33 Ramp end
35 Protrusion
36 Recess
40 Fix element
41 Feeding opening
42 Reing region
45 Protrusion
46 Recess
50 Ore clump
51 Ore particle
52 Ore particle
55 Comminuted ore
60 Intermediate space
61 Outlet notches
62 Outlet notches
140 Fix element
141 Fix element
143 Acceleration element
144 Angular region
145 Recess
162 Outlet notches
230 Rotation element
236 Recess
240 Fix element
241 Feeding opening
260 Intermediate space
290 Comminuting device
300 First comminuting means
301 Second comminuting means
302 First means for fixing and force transmission
303 Second means for fixing and force transmission
304 Third means for fixing and force transmission
305 Frame element
306 Wall of the housing
307 Forth means for fixing and/or force transmission
313 First lower shaft for fixing and/or actuating of the mill ring
344 Mill ring
345 First Mill drum
346 Roller bearing
347 Shaft
348 roller bearing covering element
349 Spacing element for receiving and spacing apart of shaft 347
350 Fixing of the element for spacing apart
351 Shaft
352 Inner roller bearing covering element
354 Fixing position
355 Element for guiding and/or actuating of the mill ring
356 Means for securing a shaft
357 Upper shaft for fixing and/or actuating the mill ring (respectively the axis)
358 Roller bearing for mounting the mill drum
359 Washer
360 bolt nut
361 Stop collar for fixing the mill ring
362 Inner cover element
363 Upper fixing body for fixing the mill ring
364 Disc element for fixing of a lower axis supporting the mill ring
365 Disc element for fixing an upper shaft supporting the mill ring
366 Lower fixing body for fixing the mill ring
367 Drive wheel
368 Round disc-like force transmission disc
369 Drive chain
370 Motor
371 Second lower shaft for fixing and/or actuating the mill ring
372 Belt
380 Second mill drum
381 Fixing position
382 Opening
383 Outer surface of the mill drum
384 Outer surface of the mill ring
385 Inner surface of the mill ring
386 Transportation means
388 Frame
390 Wheels
392 Coupling location
393 Rack
394 Outputting region
402 First holding means
403 Second holding means
404 Third holding means
406 Wall
408 Feeding means
410 Pumping means
412 Coupling location at the wall
413 Separating means
414 First outlet opening in the separator
416 Second outlet opening in the separator
419 Conduit section
420 Housing cover
430 Hydraulic means
432 Stator
434 Actuator
436 Actuator-Housing-Cover-Coupling
450 First additional actuator
452 Second additional actuator
500 Human
502 Opening
504 Spring means
506 Roller bearing
508 Roller bearing
520 Feeding connection
521 Axial end of the shaft
R Direction of rotation of mill ring
S1 Sliding path
T1 First transportation direction
T2 Second transportation direction
T3 Third transportation direction
X Direction

The invention claimed is:

1. A device for comminuting ore and/or slag comprising:

an ore feed unit for feeding ore to a first comminuting means;

wherein the first comminuting means includes at least two comminuting elements that are moveable relative to each other and form at least one comminuting space for the ore to be comminuted such that, by a relative movement in the form of a rotation around a rotational axis of at least one of the comminuting elements, the ore is pulverised using one or more accelerating elements having protrusions on at least one of the comminuting elements, the accelerating elements being arranged on an end face of one of the comminuting elements and accelerating and comminuting the ore to by the rotation of one of the comminuting elements;

an intermediate space being provided between the comminuting elements and/or in at least one of the comminuting elements through which the pulverised ore is conveyed during the rotation outwards from a center of the rotation and from the comminuting elements;

wherein at least one of the comminuting elements includes a functional connection with a spring means, the spring means being formed to mount at least one of the comminuting elements in functional connection so as to be variable in a direction of the other comminuting element, wherein at least one of the comminuting elements is arranged on a shaft for actuating at least one of the comminuting elements;

wherein the spring means is pretensioned through direct coupling with the shaft or at least one of the comminuting elements;

wherein the shaft and at least one of the comminuting elements are arranged to be slideable opposite to the spring force of the spring means;

a spiral shaped and ramped region is configured relative to at least one of the comminuting elements to provide a pressure application on the ore to be comminuted; and wherein at least one of the comminuting elements is arranged in a direction of extension of the rotational axis at a housing of the device to open and close a housing cover, wherein the housing cover is moveable with respect to the device and wherein at least one of the comminuting elements is pressed against the other comminuting element with the spring means when the spring means connects the housing cover with the device.

2. The device according to claim 1 wherein a sliding of the shaft and at least one of the comminuting elements takes place in dependency of the pretension of the spring means such that a deflection of the spring means results during operation of the first comminuting means due to a deflection force generated between the comminuting elements and directed opposite to a contact pressing force resulting from the spring force in the event the deflection force exceeds the contact pressing force.

3. The device according to claim 1 wherein the spring means comprises a mechanical spring means including a spiral spring, a pneumatic spring and/or a hydraulic spring.

4. The device according to claim 3 wherein the spring means has multiple suspension means with at least one suspension means being arranged in such a manner to push at least one of the comminuting elements coupled with the shaft into the direction of the other comminuting element.

5. The device according to claim 1 wherein the shaft is mounted in the housing of the device using roller bearings and is coupled with a actuating means for rotating the shaft and at least one of the comminuting elements.

6. The device according to claim 1 wherein the spring means is arranged in an end region of the shaft, the end region being spaced apart from a second end region of the shaft having one of the comminuting elements.

7. The device according to claim 1 wherein a spring constant of the spring means, a sliding path of the comminuting element and/or a deflection path of the spring means are adjustable or exchangeable.

8. A method for comminuting ore and/or slag comprising:

providing ore to an ore feed unit for feeding to a first comminuting means, wherein the first comminuting means includes at least comminuting elements that are moveable relative to each other and form at least one comminuting space for the ore to be comminuted;

providing a relative movement in the form of a rotation around a rotational axis of at least one of the comminuting elements to pulverise the ore such that one or more accelerating elements, including protrusions, are used on at least one of the comminuting elements, the accelerating elements being arranged in particular on an end face of one of the comminuting elements and accelerating and comminuting the ore to by the rotation of one of the comminuting elements;

conveying during the rotation the pulverised ore outwards from a center of the rotation and from the comminuting elements through an intermediate space between the comminuting elements and/or in at least one of the comminuting elements;

mounting a spring means in a functional connection with at least one of the comminuting elements with variability in a direction of the other comminuting element;

arranging at least one of the comminuting elements on a shaft used for actuating at least one of the comminuting element;

coupling with pretension the spring means directly with the shaft or at least one of the comminuting elements;

arranging the shaft and at least one of the comminuting elements to be slideable opposite to a spring force of the spring means;

arranging a spiral shaped and ramped region relative to at least one of the comminuting elements to provide a pressure application on the ore to be comminuted; and arranging at least one of the comminuting elements in a direction of extension of the rotational axis of a housing of the device to open and close a housing cover, the housing cover being moveable with respect to the device such that at least one of the comminuting elements is pressed against the other comminuting element by means of the spring means when the spring means connects the housing cover with the device.

* * * * *